US012351216B2

(12) United States Patent
Mandler

(10) Patent No.: US 12,351,216 B2
(45) Date of Patent: Jul. 8, 2025

(54) COUPLING BETWEEN MOVING CARS OF A TRANSPORTATION SYSTEM

(71) Applicant: DIRECTRAINS LTD., Zihron Ya'akov (IL)

(72) Inventor: Alberto Rodrigo Mandler, Zihron Ya'akov (IL)

(73) Assignee: DirecTrains Ltd., Zihron Ya'akov (IL)

( * ) Notice: Subject to any disclaimer, the term of this patent is extended or adjusted under 35 U.S.C. 154(b) by 751 days.

(21) Appl. No.: 17/614,576

(22) PCT Filed: Jun. 15, 2020

(86) PCT No.: PCT/IB2020/055568

§ 371 (c)(1),
(2) Date: Nov. 29, 2021

(87) PCT Pub. No.: WO2021/014230

PCT Pub. Date: Jan. 28, 2021

(65) Prior Publication Data

US 2022/0234631 A1 Jul. 28, 2022

Related U.S. Application Data

(60) Provisional application No. 62/877,853, filed on Jul. 24, 2019.

(51) Int. Cl.
*B61G 5/00* (2006.01)
*B61G 3/16* (2006.01)
(Continued)

(52) U.S. Cl.
CPC ..... *B61G 5/00* (2013.01); *B61G 3/16* (2013.01); *B61G 7/08* (2013.01); *B61K 1/00* (2013.01); *B61L 15/0072* (2013.01)

(58) Field of Classification Search
CPC ... B61K 1/00; B61G 3/16; B61G 3/14; B61G 3/10; B61G 5/00; B61G 5/02; B61G 7/08; B61L 15/0072
See application file for complete search history.

(56) References Cited

U.S. PATENT DOCUMENTS 335,611 A 2/1886 Moorman
593,195 A 11/1897 Cavniss
(Continued)

FOREIGN PATENT DOCUMENTS

CN 101480954 A 7/2009
CN 103465915 A 12/2013
(Continued)

OTHER PUBLICATIONS

Hunter-Zaworski, "Analysis of Passenger Incident Data from Five Rail Transit Systems," MDPI Journal Safety, vol. 3, No. 21, pp. 1-10, year 2017.
(Continued)

*Primary Examiner* — Zachary L Kuhfuss
*Assistant Examiner* — Cheng Lin
(74) *Attorney, Agent, or Firm* — Meitar Patents Ltd.; Daniel Kligler

(57) ABSTRACT

A coupling assembly (100) in a first car (12) configured to move relative to a second car (18), the coupling assembly (100) includes an extender (88) and a connector (99). While the first and second cars (12, 18) are both in motion, the extender (88) is configured to extend away from the first car (12) for connecting with the second car (18). The connector (99) is coupled to the extender (88) and is configured to perform the following while the first and second cars (12, 18) are both in motion: (i) connect with a mating connector (98) of the second car (18) when connecting between the first and second cars (12, 18), and (ii) disconnect from the
(Continued)

mating connector (98) when disconnecting the first car (12) from the second car (18).

18 Claims, 4 Drawing Sheets

(51) Int. Cl.

| | |
|---|---|
| ***B61G 7/08*** | (2006.01) |
| ***B61K 1/00*** | (2006.01) |
| ***B61L 15/00*** | (2006.01) |

(56) References Cited

U.S. PATENT DOCUMENTS

| | | | | |
|---|---|---|---|---|
| 950,263 | A | 2/1910 | Harpster | |
| 1,450,248 | A * | 4/1923 | Carr | B61G 3/16 213/89 |
| 2,747,890 | A * | 5/1956 | Gerhardt | B61G 5/02 280/406.1 |
| 3,354,836 | A | 11/1967 | Willison et al. | |
| 3,450,271 | A * | 6/1969 | Bissett | B61G 5/00 213/75 D |
| 3,848,533 | A * | 11/1974 | Grow | B61K 1/00 104/18 |
| 5,312,007 | A | 5/1994 | Kaufhold et al. | |
| 5,797,330 | A | 8/1998 | Li | |
| 6,685,040 | B2 * | 2/2004 | Heinisch | B61D 15/06 213/220 |
| 8,370,006 | B2 | 2/2013 | Kumar et al. | |
| 9,376,128 | B2 * | 6/2016 | Paulino | B61L 3/127 |
| 10,328,960 | B2 | 6/2019 | Fifield | |
| 2003/0167960 | A1 * | 9/2003 | Rosenblatt | B61K 1/00 104/27 |
| 2005/0039629 | A1 | 2/2005 | Mayer et al. | |
| 2007/0272115 | A1 | 11/2007 | Mayer et al. | |
| 2008/0103639 | A1 | 5/2008 | Troy et al. | |
| 2009/0152391 | A1 | 6/2009 | McWhirk | |
| 2013/0153714 | A1 | 6/2013 | Qu et al. | |
| 2015/0224845 | A1 | 8/2015 | Anderson et al. | |
| 2016/0274591 | A1 * | 9/2016 | Bick | G05D 1/0027 |
| 2018/0079436 | A1 * | 3/2018 | Fifield | B61L 27/40 |
| 2019/0241079 | A1 * | 8/2019 | Huo | B60L 8/003 |
| 2020/0189631 | A1 * | 6/2020 | Gorman | B61L 15/0072 |

FOREIGN PATENT DOCUMENTS

| | | | | |
|---|---|---|---|---|
| CN | 106828507 | A | 6/2017 | |
| DE | 2745158 | A1 | 4/1979 | |
| DE | 102007038345 | A1 * | 9/2008 | B61B 1/00 |
| GB | 2232649 | A | 12/1990 | |
| TW | 200840746 | A | 10/2008 | |
| WO | 2016108785 | A1 | 7/2016 | |
| WO | 2018071991 | A1 | 4/2018 | |
| WO | 2020208438 | A1 | 10/2020 | |

OTHER PUBLICATIONS

Dingler et al., "Determining the Causes of Train Delay," Proceedings of the American Railway Engineering and Maintenance-of-Way Association (AREMA) Annual Conference 2010, pp. 1-14, year 2010.

Priestmangoode, "Britain's Leading Transport Designer Unveils the Future for 21st Century Train Travel," pp. 1-2, Dec. 2014.

YouTube Clip, "The Train that Never Stops at a Station," Apr. 14, 2010, https://www.youtube.com/watch?v=p9lg19gYP9o.

YouTube Clip, Moving Platform: Train Stations go Mobile with High-Speed docking DVICE2.mp4, Jun. 25, 2011, https://www.youtube.com/watch?v=19hXm0J_3Uc.

YouTube Clip, "Automatic Train Coupler," Rail System Net, Apr. 23, 2015, https://www.youtube.com/watch?v=kpf2f5dPIFg.

Pfaff, "Analysis of Big Data Streams to Obtain Braking Reliability Information for Train Protection Systems," Open Access Article, Conference Contribution, Asia Pacific Conference of the Prognostics and Health Management Society 2017, pp. 1-7, year 2017.

Funke et al., "Development of Functional Requirements for Sustainable and Attractive European Rail Freight—D5.1—State of the Art on Automatic Couplers," Project Funded from the European Union's Horizon 2020 Research and Innovation Programme, pp. 1-72, Mar. 3, 2017.

Voith, "Railways Couplers and Connections", Product Information, pp. 1-16, year 2021 as downloaded from https://voith.com/corp-en/connection-components-couplings/railway-couplers.html?99624%5B%5D=4.

Railway Engineering Standard I.S. EN 12663-1:2010, "Railway Applications—Structural Requirements of Railway Vehicle Bodies—Part 1: Locomotives and Passenger Rolling Stock (and Alternative Methods for Freight Wagons)," p. 1-39, Mar. 2010.

Railway Engineering Standard SS EN 16019:2014, "Railway Applications—Automatic Coupler—Performance Requirements, Specific Interface Geometry and Test Method," Swedish Standards Institute, pp. 1-40, Mar. 31, 2014.

International Application # PCT/IB2020051995 Search Report dated Jun. 18, 2020.

International Application # PCT/IB2020055568 Search Report dated Sep. 9, 2020.

EP Application # 20843887.9 Search Report dated Jun. 30, 2023.

U.S. Appl. No. 17/601,726 Office Action dated Jun. 14, 2023.

EP Application # 20787120.3 Search Report dated Dec. 6, 2022.

* cited by examiner

COUPLING BETWEEN MOVING CARS OF A TRANSPORTATION SYSTEM

CROSS-REFERENCE TO RELATED APPLICATIONS

This application is U. S. National Phase of PCT Application PCT/IB2020/055568, which claims the benefit of U.S. Provisional Patent Application 62/877,853 filed Jul. 24, 2019. The disclosures of these related applications are incorporated herein by reference.

FIELD OF THE INVENTION

The present invention relates generally to transportation systems, and particularly to methods and systems for coupling between moving cars of non-stop transportation systems.

BACKGROUND OF THE INVENTION

Various types of techniques for connecting between cars of transportation systems have been described in the patent literature.

For example, U.S. Patent Application Publication 2016/0274591 describes a vehicle combination and a method for forming and operating a vehicle combination that includes at least first and second autonomous vehicles. Each of the autonomous vehicles is configured to automatically control its motions in a state wherein the first and second autonomous vehicles do not form the vehicle combination. When the vehicle combination is formed, the two autonomous vehicles are connected via a communications connection and the first autonomous vehicle automatically controls the motion of the second autonomous vehicle via the communication connection.

U.S. Pat. No. 5,312,007 describes a slackless railcar coupler assembly, which is mountable in a railcar center sill, has a draft mar subassembly operable against a rear stop, and a slackfree coupler apparatus mounted in a coupler pocket forward of said draft gear subassembly.

SUMMARY OF THE INVENTION

An embodiment of the present invention that is described herein provides a coupling assembly in a first car configured to move relative to a second car, the coupling assembly includes an extender and a connector. While the first and second cars are both in motion, the extender is configured to extend away from the first car for connecting with the second car. The connector is coupled to the extender and is configured to perform the following while the first and second cars are both in motion: (i) connect with a mating connector of the second car when connecting between the first and second cars, and (ii) disconnect from the mating connector when disconnecting the first car from the second car.

In some embodiments, the extender includes a telescopic extender (TE). In other embodiments, the extender is configured to extend away from the first car and the connector is configured to connect with the mating connector when the first and second cars are separated from one another by a first distance, and after connecting between the connector and the mating connector and while the first and second cars are both in motion, the extender is configured to at least partially collapse toward the first car for positioning the first car at a second distance from the second car, smaller than the first distance. In yet other embodiments, at least one of the first and second cars includes a transportation equipment selected from a list consisting of: a bus, an intercity train, a light train, a suburban rail, an underground train, a boat, an automobile, a truck, a ship, an aircraft and a drone.

In an embodiment, the coupling assembly includes a first local control unit (LCU) coupled to the first car, and a second LCU coupled to the second car, the first and second LCUs include (i) one or more sensors, (ii) one or more communication devices, and (iii) a processor, configured to receive signals from the sensors and the communication devices, and based on the received signals, to control connection and disconnection between the first car and the second car. In another embodiment, the signals include at least first and second signals, and the processor is configured, in response to receiving the first signal, to control the extender to extend away from the first car, and in response to receiving the second signal, to control the extender to collapse toward the first car. In yet another embodiment, the processor is configured to control one or more parameters selected from a list consisting of (a) speed, (b) acceleration and deceleration, (c) a distance between the first and second cars, (d) a distance to a nearest station, (e) a distance to a hazard, and (f) braking capabilities. In an embodiment, the extender is configured to collapse toward the first car for disconnecting from the second car.

In some embodiments, the one or more sensors are configured to sense one or more physical parameters selected from a list consisting of (a) speed, (b) acceleration and deceleration, (c) a distance between the first and second cars, and (d) a distance to a hazard. In other embodiments, the first LCU includes a first communication device and the second LCU includes a second communication device, and, (a) when the connector and the mating connector are disconnected, the first and second communication devices are configured to exchange the signals wirelessly, and (b) when the connector and the mating connector are connected, the first and second communication devices are configured to exchange at least some of the signals over a wired connection, in yet other embodiments, the coupling assembly includes a first set of one or more first cars and a second set of one or more second cars, the first and second sets of cars are moving along a route, and the first and second LCUs are configured to control: (a) a connection between the first and second sets at a first section of the route, and (b) a disconnection between the first and second sets at a second section of the route.

In an embodiment, the first and second cars are disconnected from one another and are moving along a route such that the first car is a leading car and the second car is following the first car, and, in response to detecting a hazard along the route, the first and second LCUs are configured to coordinate deceleration of the first and second cars. In another embodiment, the second LCU is configured to control the second car to decelerate, and subsequently, the first LCU is configured to control the first car to decelerate. In yet another embodiment, the extender is configured to damp an impact occurring when connecting between the first car and the second car.

There is additionally provided, in accordance with an embodiment of the present invention, a method for coupling a first car moving relative to a second car, the method includes, while the first and second cars are both in motion and are separated from one another by a given distance: extending away from the first car, an extender for connecting with the second car, and a connector coupled to the extender and a mating connector of the second car are connected to one another.

The present invention will be more fully understood from the following detailed description of the embodiments thereof, taken together with the drawings in which:

DETAILED DESCRIPTION OF EMBODIMENTS

Overview

Figure 1:
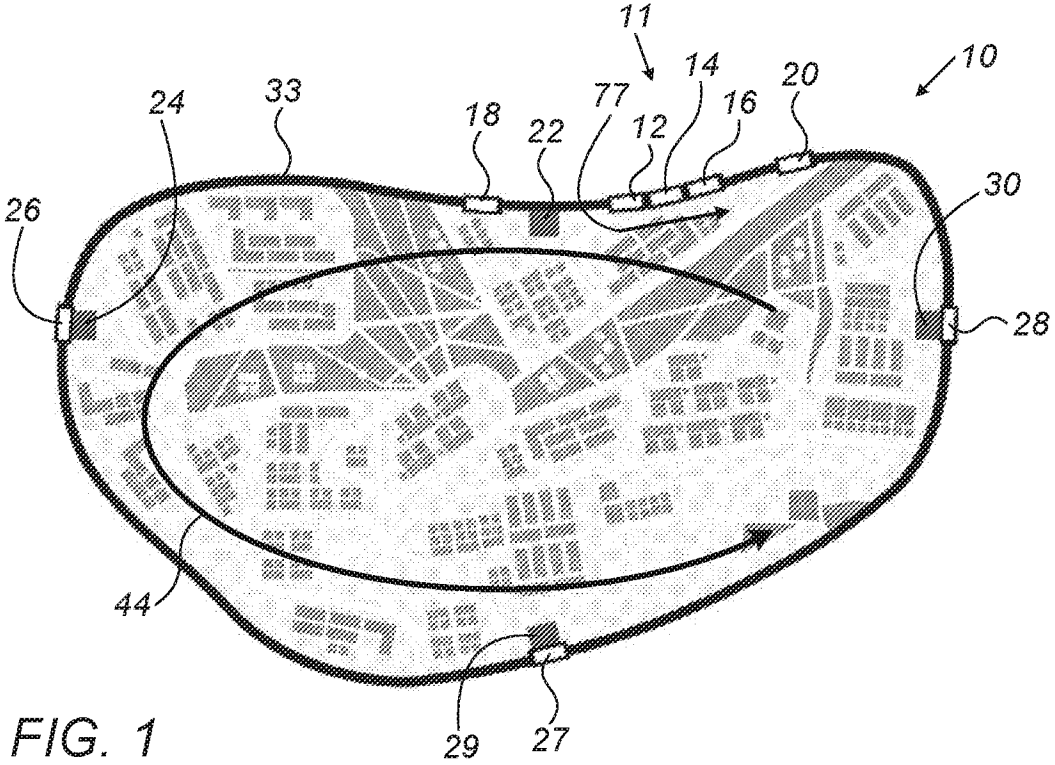
FIG. 1 is a schematic, pictorial illustration of a system for transporting objects without stopping, in accordance with an embodiment of the present invention.

Embodiments of the present invention that are described hereinbelow provide methods and systems for connecting between two or more moving cars, also referred to herein as dynamic coupling.

In some embodiments, a first car, which is configured to move at a given speed relative to a second car, has a coupling assembly comprising an extender, such as but not limited to a telescopic extender (TB), and a connector (CN) coupled to the TE. While the first and second cars are both in motion, and are located at a predefined distance from one another, the FE is configured to extend away from the first car for connecting with the second car, or with a coupling assembly thereof.

In some embodiments, while the first and second moving cars are located within the predefined distance from one another, the CN of the first car is configured to connect with a mating CN of the second car. In some embodiments, after connecting between the CNs, the TE is configured to collapse toward the first car for coupling between the first and second cars. In other embodiments, after connecting between the CNs, the TE may remain extended without collapsing, or may partially collapse.

In some embodiments, the connected CNs have a latching or locking; mechanism so that after coupling therebetween, the first and second cars constitute two coupled cars of a train or any other suitable type of vehicle.

Note that the predefined distance is determined, inter alia, by the extension size of the TE. In some embodiments, the second car may also have a coupling assembly similar to that of the first car, so that the predefined distance may be increased by extending a TE of the second car. Moreover, the predefined distance may be controlled by setting the amount of extension in the TE of each car.

In some embodiments, each of the first and second cars may have one or more sensors, configured to sense, for the respective car, one or more of the following parameters: (a) speed, (b) acceleration and deceleration, and (c) distance between the first and second cars. Each car may also have a communication device, which is configured to transmit and receive signals indicative of the sensed parameters. For example, the communication device of the first car may transmit a signal indicative of the parameters sensed in the first car, to the communication device of the second car, and receive, from the communication device of the second car, another signal indicative of the parameters sensed in the second car.

In some embodiments, at least the first car (and typically both cars) may have a processor, which is configured, in response to receiving a first signal, to control the TE to extend away from the first car, and in response to receiving a second signal, to control the TE to collapse toward the first car. The processor of at least one of the cars is configured to disconnect between the first and second cars by extending the TE away from the first car, followed by disconnecting between the CNs, and subsequently, collapsing the TE toward the first car. During the disconnection process, the processor is configured to control various parameters, such as but not limited to relative speed and distance between the first and second cars.

In some cases, the first and second cars are moving along a route, such that the first car is a leading car and the second car is following the first car but is not mechanically connected to the first car. In some embodiments, a sensor of the first car may detect a hazard along the route, and the communication device of the first car may transmit, to the communication device of the second car, an alert signal indicative of the detected hazard.

In some embodiments, in response to receiving the alert signal, the first and second processors are configured to coordinate a deceleration of the first and second cars. In such embodiments, the processor of the second car is configured to control a deceleration of the second car, and subsequently, the processor of the first car is configured to control a deceleration of the first car, such that a safety margin is maintained between the first and second cars. Moreover, after the deceleration of both cars, the processors are configured to control any suitable relative speed between the first and second cars, e.g., maintaining the same level of relative speed controlled before detecting the hazard.

In other embodiments, in case an emergency stop is required due to the detected hazard, in response to receiving the alert signal, the first and second processors are configured to coordinate an emergency stop of the first and second cars. For example, when the second car follows the first car, the processor of the second car is configured to control an emergency stop of the second car, and subsequently, the processor of the first car is configured to control an emergency stop of the first car, such that the safety margin is maintained between the first and second cars.

In alternative embodiments, at least the first car may comprise an extender other than the telescopic extender (TE) described above. The extender may be extended and/or collapsed using any suitable mechanical mechanism, which is powered mechanically and/or electrically and/or pneumatically, and/or using any suitable combination thereof. Moreover, any other suitable type of extender may be used, instead of or in addition to at least one of the aforementioned TEs.

The disclosed techniques are not limited to trains. In some embodiments, the transportation system may comprise any other type of transportation vehicle, such as but not limited to a bus, an intercity train, a light train, a suburban rail, an underground train, metropolitan trains, a boat, an automobile, a truck and an aircraft. Moreover, the transportation system may transport any suitable types of objects, e.g., passengers, parcels, cargo and/or freight or any suitable combination thereof.

The disclosed techniques improve the efficiency of transportation systems by enabling connecting and disconnecting between at least two moving cars, so as to reduce the commuting time of passengers and other objects, connecting two trains to reduce headways (the term headway refers to safety distance required from each car and/or train), and therefore, use more cars in a given transportation line for improving line capacity. Moreover, the disclosed techniques improve efficiency of connecting trains in staging yards. The term staging yards refers to side tracks of route 33, used for connecting between cars.

System Description

FIG. 1 is a schematic, pictorial illustration of a system 10 for transporting objects without stopping, in accordance with an embodiment of the present invention. In some embodiments, system 10 comprises a vehicle 11 having one or more cars. In the present example, vehicle 11 comprises a train having cars 12, 14 and 16 coupled to one another and arranged in a column along a track, referred to herein as a route 33.

In some embodiments, vehicle 11 is configured to move, in direction 44 along route 33 having one or more stations (e.g., stations 22, 24, 29 and 30), without stopping at any of the aforementioned stations. Moreover, vehicle 11 continuously moves along route 33, typically at a predefined speed, without changing its velocity when passing by a station or when moving between stations. The speed of vehicle 11 may be constant along route 33, or may change to a desired speed in accordance with the administrative requirements of system 10.

In the example of FIG. 1, route 33 appears to be circular. In other embodiments, route 33 may have any other suitable shape and/or configuration, such as but not limited to a linear shape (e.g., north to south), a curved shape, and/or two routes crossing one another.

In some embodiments, system 10 comprises one or more cars, such as cars 18, 26, 27 and 28, each of which is configured to load an object (e.g., a passenger) from a station and to move for integrating with vehicle 11.

In the example shown in FIG. 1, car 18 loads passengers from station 22 and, when vehicle 11 is located at a predefined distance from station 22, car 18 starts moving along route 33 in direction 44. In such embodiments, car 18 accelerates after departing from station 22 and system 10 is configured to match the speed of vehicle 11 and car 18 when making a physical contact therebetween.

In other words, car 18 departs from station 22 before vehicle 11 passes by station 22, e.g., when vehicle 11 is located at the aforementioned predefined distance from station 22. Subsequently, car 18 accelerates, for a predefined time interval, so as to obtain approximately the speed of vehicle 11. During the predefined time interval, vehicle 11 that moves at a speed higher than that of car 18, reduces the distance therebetween. At the end of the predefined time interval, vehicle 11 makes physical contact with car 18 when the speeds of car 18 and vehicle 11 are approximately matched. Subsequently, vehicle 11 and car 18 are making a dynamic coupling therebetween so that car 18 is integrated into vehicle 11 and constitutes the front car thereof.

In the context of the present disclosure and in the claims, the terms "about" or "approximately" for any numerical values or ranges indicate a suitable dimensional tolerance that allows the part or collection of components, or a physical parameters such as speed and time, to function for its intended purpose as described herein. More specifically, "about" or "approximately" may refer to the range of values ±20% of the recited value, e.g. "about 90%" may refer to the range of values from 71% to 99%.

In some embodiments, at least one of (and typically all of) the cars of system 10 is configured to detach from vehicle 11 (when vehicle 11 moves) and to decelerate for a given time interval from a respective station, so as to obtain a full stop at the respective station for unloading another object (e.g., another passenger).

In the example shown in FIG. 1, when vehicle approaches station 22, car 20 detaches from vehicle 11 and decelerates so as to stop at station 22 and to unload passengers at station 22 when vehicle 11 continues moving at a desired speed and integrates with car 18 as described above.

In some embodiments, car 20, which is the unloading car, is positioned at the rear of vehicle 11. Moreover, after integrating with vehicle 11, car 18 constitutes the front car of vehicle 11 as described above.

In the example of FIG. 1, only one car (e.g., car 18) loads passengers from station 22, and only one car (e.g., car 20) unloads passengers at station 22. In other embodiments, at least one of the loading and unloading cars may comprise any suitable number of cars. For example, in case station 22 is a central station of a metropolis, when a large volume of passengers arrives in station 22 (e.g., in morning trains), the unloading car (e.g., car 20) may comprise multiple cars. Similarly, when a large volume of passengers depart from station 22 (e.g., in afternoon and evening trains), the loading car (e.g., car 18) may comprise multiple cars.

In some embodiments, car 26 is loading passengers at station 24, and starts moving along route 33 in direction 44 when vehicle 11 is positioned (while moving) at a predefined distance from station 24. Note that after integrating with vehicle 11, car 26 is the front car of vehicle 11 and car 18 will become the second car of vehicle 11.

In such embodiments, the position of one or more cars of vehicle 11 within vehicle 11, is changing along route 33. For example, between stations 30 and 22 car 12 is at the front position and car 20 is at the rear position, and when approaching station 22, car 20 detaches from vehicle 11 and car 16 turns into the rear car of vehicle 11. Similarly, between stations 22 and 24, car 18 is at the front position and car 16 is at the rear position, and when approaching station 24, car 16 may detach from vehicle 11 and car 14 may turn into the rear car of vehicle 11.

Note that in some cases vehicle 11 may pass by a given station without detaching one or more cars, and/or without integrating with a car loading passengers from the given station. In an embodiment, car 16 may not detach from vehicle 11 between stations 22 and 24, and may remain the rear car having a different destination, e.g., station 29. In this embodiment, vehicle 11 may integrate with car 26 between stations 24 and 29 and may have five cars (e.g., cars 26, 18, 12, 14 and 16) before detaching from car 16 when approaching station 29.

In some embodiments, a passenger typically boards an origin car that, after the integration, is located at the front of vehicle 11. During the ride the passenger moves within vehicle 11 in a direction 77 (opposite to direction 44), toward a destination car that is located at the rear of vehicle 11. For example, a passenger traveling from an origin station (e.g., station 28) to a destination station (e.g., station 22), may board car 12 at station 28 and walk (or he moved using any suitable technique) along vehicle 11 to car 20, so as to de-board at station 22. In case the destination station of the passenger is station 29, he or she may walk from car 12 to car 14, which is designated to stop at station 29 and de-board from car 14. Note that moving passengers, within vehicle 11 in direction 77, prevents crowding and passengers congestion, and therefore, improves the mobility and flow of the passengers within vehicle 11.

In accordance with the embodiments described above, for a typical passenger each car is a direct car to its destination station. In the context of the present invention and in the claims, the term "direct car" refers to the fact that once boarding an origin car at the origin station, a given passenger moves along vehicle 11 to its destination car and typically stops only at its destination station. In other words, the given passenger does not waste time due to a stop at any station located between the origin and destination stations, because vehicle 11 constantly moves. Therefore, from the passenger perspective, after boarding, the destination car stop only at the destination station. Moreover, a passenger sits at his or her destination car until the car is detached from vehicle 11 and stops at the destination station, while typically vehicle 11 has not changed its original (e.g, cruising) speed since departure from the origin station.

Typically, when accessing a station of system 10, a passenger does not have to wait for a specific car and can take the next car. In some embodiments, system 10 is configured to route the cars and vehicles to transport the passenger to its destination station using various techniques described below. Moreover, due to the direct car and non-stop vehicles, the transportation is faster and the passenger spends less time commuting.

In some embodiments, in case the destination car is not yet coupled to vehicle 11, the passengers may await at one of the cars of vehicle 11, for a notice that their destination car is integrated with vehicle 11 and is available for them. In such embodiments, a passenger may (a) remain in the origin car that has a destination station that matches the passenger's destination station, or (b) move to the destination car that has not yet been integrated with vehicle 11. Note that in scenario (a), the passenger will not move in direction 77, and simply de-board the same car at the destination station.

Signage within Elements of the Transportation System

In some embodiments, system 10 comprises at least the following elements: vehicles having one or more cars, cars not connected to vehicles, and the aforementioned stations located along route 33. In some embodiments, system 10 has signs for assisting the passengers in reaching their destination in the most effective manner. In some embodiments, digital (electronic) signs are positioned (a) in every station, (b) in every car, and (c) the passengers may have a handheld device, such as a smartphone or a head-mounted display (HMD), which is connected to a control sub-system of system 10 and displays information regarding the schedule and destination of each car of system 10.

In some embodiments, each station has signs indicative of the departure and arrival times of cars at the station, and optionally on departures and arrivals of cars at other stations of system 10. In the example of FIG. 1, the signs of station 22 may display the arrival time of car 20 and the departure of car 20 that will be integrated with the next vehicle (not shown) following vehicle 11. Similarly, the signs of station 24 may display (a) the departure time of car 26, and in case car 16 is scheduled to detach from vehicle 11 and to stop at station 24, the signs will display (b) the arrival time of car 16. Note that the signs of each station may also display information regarding other stations along route 33 and the destination of each car currently integrated in vehicle 11.

In some embodiments, each car has a sign that marks the destination station thereof. The sign may also comprise a mapping of all the cars of system 10, which are lit according to coupling and destination station. Such signs provide the passengers with information on the destinations of all cars currently integrated in vehicle 11. Thus, each passenger knows his or her destination car in order to reach the respective destination station.

In some embodiments, the signage of each car displays the car status (e.g., coupling status, origin and destination), the position of each car within vehicle 11, and whether or not passengers can move from the respective car toward their destination car of vehicle 11. For example, when car 18 departs from station 22, but is not yet safely coupled to vehicle as shown in FIG. 1, the signage displays that passengers of car 18 cannot move toward the rear of vehicle 11. Similarly, before car 20 detaches from vehicle 11, the signage of cars 12, 14 and 16 display the remaining time for safely passing to car 20. At a predefined time interval (e.g., ten seconds) before detaching car 20, the signage of cars 12, 14 and 16 may indicate that car 20 is no longer available for the present passengers of vehicle 11. Moreover, the signage of car 20 may have a count-down display for the arrival of car 20 in station 22.

In some embodiments, the signage may display the status and destination of each car of system 10, or of some of the cars of system 10. In the context of the present invention, the term "status" may refer to at least one of (a) whether the car moves or stops, (b) whether the car (i) loads passengers, or (ii) unloads passengers, or (iii) in idle or mode (e.g., for technical maintenance, or cleaning). For example, a moving car may be highlighted, and displays its corresponding destination.

In such embodiments, a car that is positioned at a given station, and therefore is not moving, may have a corresponding indication of its status as described above, and a sign indicative of its destination that may be displayed at all stations, cars and personal displays. Moreover, the signage may provide users with an indication of whether or not each car is dynamically coupled to a respective vehicle. In the example of FIG. 1, the signage will indicate that cars 12, 14 and 16 are dynamically coupled to one another, whereas cars IS and 20 are moving but are not coupled to any car of vehicle 11.

In some embodiments, the signage may be carried out using color-coding, letters, lit and unlit, characters, or any other suitable marking indicative of the status of the respective car. Additionally, each car may have the destination thereof shown on the outer surface of the car so that passengers at the respective stations will be able to see the destination of the respective car.

In some embodiments, passengers having a personal displaying device, such as but not limited to the aforementioned smartphone or HMD, may have all the information described above displayed on the personal device. In such embodiments, the personal device may provide the user with the destination of the car he or she is currently located in, and may further provide the user with the position of its destination car and the estimated arrival time of the destination car at the destination station.

This particular configurations of the signage of system 10 are described by way of example, in order to enhance the performance and ease-of-use of system 10. Embodiments of the present invention, however, are by no means limited to this specific sort of example signage configurations, and the principles described herein may similarly be applied to other sorts of signage in system 10 or in any other types of transportation systems.

Control Sub-System of the Transportation System

In some embodiments, system 10 comprises the aforementioned control sub-system. In an embodiment, the control sub-system may be centralized, referred to herein as a central control unit (CCU). In another embodiment, the control sub-system may be distributed, referred to herein as a distributed control unit (DCU). For example, a DCU may be positioned at the large stations of system 10 that are distributed along route 33 and/or as local-control units (LCUs) coupled to at least some of the aforementioned cars of system 10, as will be described in detail in FIG. 2 below.

The embodiments below are described for the CCU, but are also applicable to the DCU.

In some embodiments, the CCU may comprise various types of sensors, communication devices, controllers and processors (described in detail below), which are configured to accurately assess the position, speed and acceleration of each car in real-time.

In some embodiments, based on the sensed and communication signals, a processor of the CCU is configured to estimate and/or specify various parameters related to components (e.g., each car and vehicle) of system 10. The processor is configured to control (a) speed, (b) acceleration and deceleration, (c) a distance between adjacent car or vehicle, (d) a distance to and/or from a nearest station, (e) a distance to a closest obstacle or hazard, (f) status of each car, such as but not limited to detaching from a vehicle, integrating with a vehicle, awaiting at a station, (g) status of the vehicle, e.g., number of cars and motors integrated in the vehicle, and (h) braking capabilities.

In the context of the present disclosure and in the claims, the term "braking capability" refers to at least one of (i) reducing the power applied to a motor (e.g., electrical, diesel) driving the respective car, and (ii) applying a mechanical braking assembly (e.g., friction-based) for stopping the respective car. Both braking capabilities are affected by various parameters, such as but not limited to (a) total weight of the car, (b) materials of the mechanical braking assembly, (c) number of mechanical braking actuators used (e.g., not bypassed) in the braking assembly, (d) latency period for activating a braking actuator (e.g., building a pressure in braking pistons), and (e) temperature of the braking environment and of elements of the mechanical braking assembly.

In some embodiments, the CCU is configured for signaling and controlling the components speed, acceleration and for commanding coupling and/or de-coupling between at least two cars and between a car and a vehicle.

The CCU is further configured to command cars and/or vehicles to abort coupling and/or decoupling processes when required. As will be described in detail below, one or more of the control sub-systems (e.g., CCU, and/or in stations, and/or in cars) are configured to control the cars and stations for maintaining a safety distance between adjacent components (e.g., cars). In other words, based on the signals received from at least one of the sensors and the communication devices the control sub-system is configured to specify the configuration of at least one of the vehicle (e.g., vehicle 11) and one or more of the aforementioned cars of system 10.

Typically, the control sub-system comprises a general-purpose computer having at least a processor and/or a controller, which is programmed in software to carry out the functions described herein. The software may be downloaded to the computer in electronic form, over a network, for example, or it may, alternatively or additionally, be provided and/or stored on non-transitory tangible media, such as magnetic, optical, or electronic memory.

Additional embodiments related to the control sub-systems and components thereof in the stations and the cars of system 10 are described in detail below.

In the context of the present disclosure and in the claims, the terms "integrate with" and "couple to" are used interchangeably, the terms "detach" and "decouple" are used interchangeably, the terms "loading" and "boarding" are used interchangeably, and the terms "de-boarding" and "unloading" are used interchangeably.

Addressing Specific Scenarios and Requirements of the Transportation System

In some cases vehicle 11 may have less cars than number of stations. In some embodiments, one or more given cars of vehicle 11 may have respective destination stations, but also intermediate destination stations. In such embodiments, the passengers will wait in the given car they boarded until the car of their destination is picked up later, and then pass to their destination car at the front of vehicle 11.

In some embodiments, system 10 is configured to manage connection of passengers between different routes having at least one common station. For example, a passenger departing from Pittsburgh, Pennsylvania with a destination station at Richmond, Virginia, will wait at a given car dropped-off at the Baltimore station, and the given car will be integrated with the vehicle coming from New York using the same techniques described above for car 18 and vehicle 11. After the integration, the passenger may walk to the destination car intended to stop at Richmond as its destination station.

In order to avoid passengers moving in direction 44 towards the front of vehicle 11, an alternative embodiment of system 10 is possible in cases where destination car is unavailable due to a short vehicle 11. In this embodiment, the passengers remain in an "intermediate car" but may not de-board from the intermediate car even though the intermediate car is detached from vehicle 11 and stops at a station, because the intermediate car will integrate with a subsequent vehicle (other than vehicle 11). After the integration with the subsequent vehicle, the passengers will move towards the back of the subsequent vehicle, to the destination car of their destination.

In some embodiments, the cars constituting vehicle 11 may be concatenated or split to allow better utilization of the shared vehicles. Because the passengers typically sit in their destination car before the splitting, the passengers do not move while vehicle 11 is being split, thus avoiding safety events. In such embodiments, when accessing a station (e.g., by foot), each passenger may relate to the car awaiting at the platform as his or her next car, assuming that all cars and vehicles that are sharing the same line are concatenated and/or split as needed. These embodiments are applicable for all passengers because each vehicle that passes through a station can arrive to all possible stations by concatenating and splitting.

In some embodiments, a vehicle having a first set of cars of system 10, such as vehicle 11, is configured to merge with another vehicle having a second set of cars, and/or to split into multiple sub-vehicles. In such embodiments, when a vehicle splits into two or more sub-vehicles, at a splitting point, the rear-most-sub-vehicle (also referred to herein as the second set of cars), reduces its speed to a predefined speed, so as to have a safety distance and to allow the one or more front sub-vehicles (also referred to herein as the first set of cars) to leave the splitting point.

In some embodiments, after obtaining the safety distance, the one or more front sub-vehicles and the rear-most-sub-vehicle are routed, each, by the CCU of system 10 to their respective routes, and the rear-most-sub-vehicle restores its original or planned speed.

Similarly, when merging two vehicles into a merged vehicle, at the merging point, the speeds are matched and the coupling is carried out in a like manner to the aforementioned dynamic coupling between a single car and a vehicle using the techniques described above.

In some embodiments, safety is obtained using a transition mechanism, which allows both cars (the rear and the front) to know, with sufficiently-high accuracy and confidence level, the actual distance and speed difference during the entire coupling process between adjacent cars and thereafter.

In some embodiments, in case of a communication-loss event during the dynamic coupling, the rear car (or the rear-most-sub-vehicle) stops immediately and the front car (or vehicle) also stops but after a time interval (depending on the position and speed of the cars), and at a lower deceleration rate, so as to maintain a safety distance therebetween. In other words, in case of a communication-loss event during dynamic coupling of front and rear cars, the front car will always move faster than the rear car so as to prevent a collision and to obtain a safety distance therebetween.

In some embodiments, each car of system 10 is configured to use the same communication and synchronization techniques in case of a need for an emergency stop at a given car. In such embodiments, the vehicle may start decelerating and/or stopping, and send a signal to the car in front of it that it can start decelerating and/or stopping at a slightly lower rate than the vehicle (e.g., vehicle 11), in order to maintain the safe distance between the vehicle and the front car.

In other embodiments, the same emergency stop technique may be applied to any car within vehicle 11 or to any other vehicle. For example, in a vehicle comprising three cars, referred to herein as a front car, a middle car, and a rear car, which may have an uncontrolled fire event in the middle car. After evacuating the passengers from the burning middle car, the front car decouples from the burning middle car and moves at the fastest speed from among the three cars. In such embodiments, the burning middle car moves at a speed slower than that of the front car, and the rear car, which is also decoupled from the burning middle car, moves at the slowest speed from among the three cars. In such embodiments, the CCU may control a diversion apparatus in route 33 to divert the burning car to a suitable different route and to stop the burning car for extinguishing the fire and other types of emergency activities at a designated safety area.

Using Short Vehicles for Short-Distance Transportation

In some cases, the distance between two or more adjacent stations may be short due to high density of passengers or goods distributed within a short section of the route. For example, in a metropolis (for passengers and parcels) and in a seaport or airport (for large cargo and/or freight) there are typically multiple short distances between adjacent station. In such cases, a passenger boarding the front car may have to rush to his or her destination car, and in some cases, the passenger may not be able to reach the destination car on time.

In some embodiments, the control sub-system of system 10 is configured to specify the number of cars in vehicle 11, e.g., based on the distance between at least two adjacent stations of route 33.

In some embodiments, system 10 may comprise a combination of (a) long vehicles for long distances between adjacent stations as described above, and (b) shorter vehicles (e.g., having less cars) for serving sections of a route having short distances between adjacent stations. For example, a shorter vehicle may comprise two or three cars, so that a passenger have to move only one or two cars during the ride between two adjacent stations, and therefore, may not have a problem to get to his or her destination car on time. Note that both the long and short vehicles are not stopping at stations of the metropolis, but are detaching from and coupling to cars before and after the stations, respectively.

In other embodiments, system 10 may comprise a combination of vehicles that are not stopping, referred to herein as non-stop vehicles such as vehicle 11, and "traditional vehicles" that stop at predefined stations for loading and unloading objects (e.g., passengers or parcels). For example, system 10 may comprise three non-stop vehicles, such as vehicle 11, and one traditional vehicle. In such embodiments, the first and second non-stop vehicles (e.g., arriving from stations out of the metropolis) may only detach cars at given stations so that passengers may have enough time for being at their destination cars well before the destination car detaches from the respective vehicle.

Subsequently, the traditional vehicle may load passengers at the given stations and transport them to their destination within the metropolis. Finally, the third non-stop vehicle may couple to cars loading passengers from the given stations and/or other stations, for transporting these passengers to stations located at distances long-enough that provide passengers with enough time to reach their destination car on time. Note that at least one of the three non-stop cars may both load and unload passengers at predefined stations. For example, a first non-stop vehicle may only detach cars, a second non-stop vehicle may detach from and integrate with cars, and a third non-stop vehicle may only integrate with cars.

In yet other embodiments, system 10 may comprise only non-stop vehicles that may move fast between metropolises and slower within the metropolises so as to provide the passengers with enough time to safely reach their destination cars before the detachment. Additionally or alternatively, system 10 may dynamically adjust the speed of the non-stop vehicles based on information received from the ticketing system. Note that the speed adjustment is limited so as to maintain the original schedule of the loading and unloading at the stations of system 10.

In other embodiments, system 10 may comprise two cars, denoted cars "A" and "B," and a single station. In such embodiments, car "A" loads passengers from the station and integrates with car B, and when approaching the station, car "B" detaches from car "A" and unloads passengers at the station. This minimal configuration may be used, for example, for improving the utilization of an attraction in an amusement park, or for any other suitable application for transporting passengers and/or goods.

Dynamic Car Planning for Transporting a Large Number of Objects to and from Stations In case of a large event, such as a football match or a big concert, a large number of passengers is expected to board at a first station, and another large number of passengers is expected to de-board at another station.

In some embodiments, the control sub-system of system 10 is configured to receive information from the ticketing system, and based on the information, to specify and/or adjust the number of cars at the first station, in response to the unusual number of passengers. For example, a first non-stop vehicle may detach, in the first station before the large amount of passengers are boarding, three cars instead of one. Subsequently, a subsequent second non-stop vehicle, may integrate with the three cars having the large amount of passengers returning from the event, and detach the three cars at the second station so as to unload at least some of the passengers returning from the event, at their destination station.

Note that in case the ticketing system receives bookings for more than one destination stations, the second non-stop vehicle may detach two of the cars at the second station and the remaining additional cars at the third station. These embodiments are also applicable for rush hours in crowded areas, such as a metropolis (for passengers and/or parcels) and a port (for cargo and/or freight).

In alternative embodiments, based on the information received from the ticketing system indicative of unusually large number of objects at the first station, the control sub-system is configured to specify (e.g., limit) the number of tickets for the second non-stop vehicle and the remaining passengers may be permitted to board a subsequent third non-stop vehicle.

In other embodiments, vehicle 11 and the cars of system 10 may comprise any other suitable type of transportation equipment, such as but not limited to a bus, an intercity train, a light train, a suburban rail, an underground train, a boat, an automobile, a truck, and a cargo and/or freight carrier (e.g., a train, a truck or a ship). In yet other embodiments, vehicle 11 may comprise an aircraft (e.g., a drone) configured to carry passengers and/or parcels along a predefined route, and the cars may comprise smaller drones configured to load and unload the passengers and/or parcels between the aircraft and the stations.

In alternative embodiments, vehicle 11 is configured to stop for coupling to and/or for detaching cars. These embodiments may be useful in case the dynamic coupling and detaching is too complicated and/or risky. This operational mode reduces some of the benefits for passengers, and may result in a long delay to passengers that plan to de-board at intermediate stations and longer overall cycle time of route 33.

In other embodiments, vehicle 11 may slow down before stations so that the dynamic coupling and decoupling (or detaching) may be carried out at lower speed. For example, if the cruising speed of vehicle 11 between stations is about 400 km per hour (KPH), the speed may decline to about 100 KPH before the dynamic coupling and/or decoupling. In other embodiments, this intermediate concept may be applied using any other suitable operational mode subject to the type of transportation as described above. For example, the speed acceleration and deceleration may differ between an intercity train and a suburban rail, and between transportation of passengers and cargo and/or freight.

This particular configuration of system 10 is shown by way of example, in order to illustrate certain problems that are addressed by embodiments of the present invention and to demonstrate the application of these embodiments in enhancing the performance of such a transportation system. Embodiments of the present invention, however, are by no means limited to this specific sort of example system, and the principles described herein may similarly be applied to other sorts of transportation systems.

Figure 2:
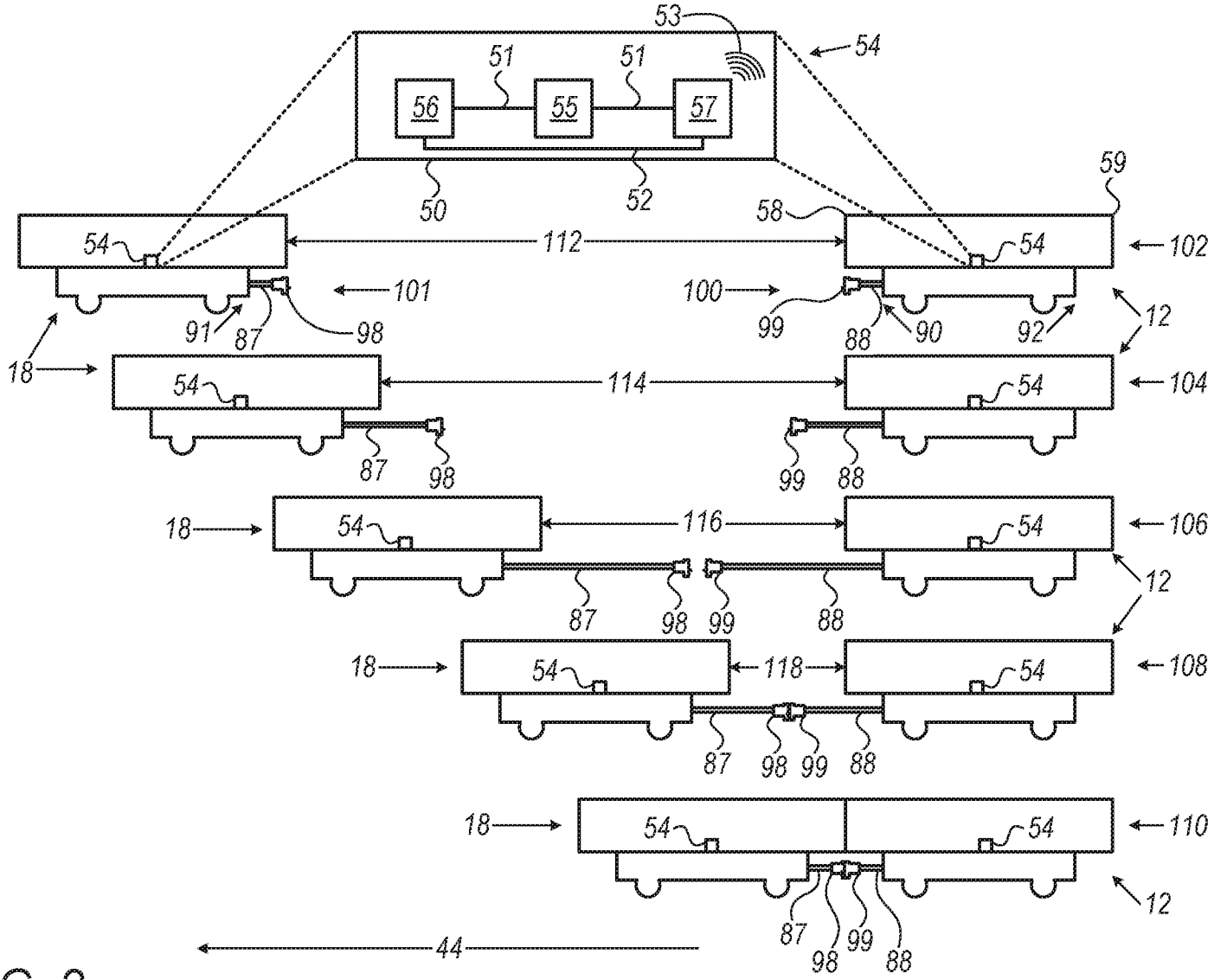
FIG. 2 is a diagram that schematically illustrates a process for connecting two moving cars of a transportation system, in accordance with an embodiment of the present invention.

Using a Coupling Assembly for Connecting Multiple Cars of the Transportation System FIG. 2 is a diagram that schematically illustrates a process for connecting two moving cars 12 and 18 of system 10, in accordance with an embodiment of the present invention. Note that the following embodiments described below for cars 12 and 18 are applicable for all the cars of system 10, and that at least one of cars 12 and 18 may be coupled to additional cars, as described in FIG. 1 above.

In some embodiments, cars 12 and 18 comprise, each, a local-control unit (LCU) 54, which is part of the distributed control unit (DCU) described in FIG. 1 above. Reference is now made to an inset 50. In some embodiments, LCU 54 comprises one or more sensors 56, which are configured to sense several physical parameters of the respective car. For example, sensors 56 of car 12 may sense speed, acceleration and deceleration of car 12, a distance between cars 12 and 18 as shown in the steps of FIG. 2, and a distance to a hazard. Note that in the example of FIG. 2, sensors 56 are shown as a box in LCU 54, but each of the aforementioned sensors 56 may be fitted at any suitable position of car 12 (and one or more other cars of system 10). For example, sensors 56 for measuring the distance between car 12 and an adjacent car, may be fitted at positions 58 and 59 of car 12. In this example, the sensor at position 58 is configured to measure the distance between cars 12 and 18.

In some embodiments, LCU 54 comprises one or more communication devices 57, which are configured to exchange signals indicative of the aforementioned measured parameters, instructions received from any processing unit of system 10, and any other suitable information. In some embodiments, LCU 54 comprises a processor 55, which is configured to receive, via electrical conductors 51 (e.g, cables, wires, leads, traces) or wirelessly, signals indicative of the parameters sensed by sensors 56 and information received from communication devices 57.

In some embodiments, based on the signals received from sensors 56 and communication devices 57, processor 55 of car 12 is configured to control (a) motion parameters of car 12, (b) coupling and decoupling procedures between car 12 and adjacent cars, as will be described in detail herein, and any other operations of car 12 and optionally of other cars of system 10. In the context of the present disclosure and in the claims, the term "motion parameters" refers to speed, acceleration, deceleration, braking, changing course, and any other suitable parameters related to the motion of the respective cars of system 10 (e.g., cars 12 and 18).

In some embodiments, LCU 54 may comprise electrical conductors 52, configured to exchange signals directly between sensors 56 and communication devices 57. This configuration may be useful, for example, for controlling both cars 12 and 18 using a single processor 55 that serves as a master processor. In the example of FIG. 2, processor 55 of car 18 may serve as a master processor that may receive the parameters sensed by sensors 56 of car 12, and may control, for example, the motion parameters of both cars 18 and 12. Note that when coupling or decoupling between two cars, processor 55 of the front car is typically defined as the master processor and processor 55 of the rear car is defined as the slave processor. In the example of FIG. 2, cars 12 and 18 are moving in direction 44, so that processor 55 of car 18 is defined as the master processor. In this example, processor 55 of car 18 controls the distance between cars 12 and 18, so that in case of emergency during a coupling process between cars 12 and 18, processor 55 of car 18 controls car 12 to reduce speed (or even stop) before changing the speed of car 18, so as to prevent a collision between cars 18 and 12. Embodiments related to the operation of LCUs 54 are described in detail in a section denoted "additional embodiments and variations" of the present disclosure. In other embodiments, both processors 55 of cars 12 and 18 may be slaves to a third party master processor, as described in detail herein. Additionally or alternatively, after defining an outline (e.g., predefined, or by a temporary master processor), both processors 55 of cars 12 and 18 may be local masters of their respective car. In alternative embodiments, processor 55 of the rear car (e.g., car 12) may serve as the master processor of both cars 12 and 18.

In the context of the present disclosure and in the claims, the terms "rear car," "trailer car" and "trailing car" are used interchangeably, and refer to the car that is not at the front (in direction 44) from among the cars being coupled or decoupled. In the example of FIG. 2, car 12 serves as the rear/trailing car. Similarly, the terms "front car" and "leading car" are used interchangeably and refer to car 18 in the example of FIG. 2.

In some embodiments, the aforementioned signals may be transmitted from and received by communication devices 57, via electrical conductors 51 and 52, and via any suitable type of wireless signals 53. In such embodiments, communication devices 57 of cars 12 and 18 are configured to exchange at least some of the signals described above, so as to control the motion parameters of cars 12 and 18. Additionally or alternatively, both processors 55 of cars 12 and 18 may be slaves to a third party master processor, located for example at the aforementioned controlled sub-system (e.g., CCU) of system 10 or at any other location. In this configuration, both communication devices 57 of cars 12 and 18 may send data to the third party master processor, and processors 55 of cars 12 and 18 may receive instructions from the third party master processor. In an embodiment, in case of communication loss with the third party master processor, one of processors 55 (e.g., the processor of car 18, which is the front car) may be assigned as a temporary master processor, until the communication channel with the third party master processor has been recovered.

Reference is now made back to the general view of FIG. 2. In some embodiments, car 12 comprises a coupling assembly (CA) 100, which is coupled to car 12 at a location 90. Similarly, car 18 comprises a (CA) 101, which is coupled to car 18 at a location 91, and may have a configuration substantially identical to that of CA 100 described herein. In the example of FIGS. 1 and 2, cars 12 and 18 are moving along route 33 in direction 44, so that location 90 is positioned at the front side of car 12, and location 91 is positioned at the rear side of car 18. Additionally or alternatively, at least one car of system 10 (and typically all cars) may have one or more CAs positioned at other locations. In the example of car 12, CA 100 may be positioned at another location of car 12, and additional CAs may be mounted on car 12 at any suitable locations other than 90 and 92.

In some embodiments, all cars of system 10 may have CAs coupled at both front and rear locations thereof. For example, car 12 may have an additional CA (not shown) coupled at location 92, so that car 12 may be coupled with an additional car, such as car 14 as shown in FIG. 1 above.

In some embodiments, CA 100 comprises a telescopic extender (TE) 88, so that while at least car 12 is in motion, TE 88 is configured to extend away from car 12 for connecting with car 18. In some embodiments. CA. 100 comprises a connector (CN) 99, which is coupled at the distal end of TE 88, but in other embodiments, CN 99 may be coupled at any other suitable position of TE 88.

In some embodiments, CA 101 comprises a TE 87 having the same features of TE 88. For example, while at least car 18 is moving, TE 87 is configured to extend away from car 18 (e.g., toward CA 100 in car 12). CA 101 comprises a CN 98, which is typically (but not necessarily) positioned at the distal end of TE 87 and having the same features of CN 99. In some embodiments, CN 99 is configured to connect with a mating connector, such as CN 98, for connecting between cars 12 and 18. In the example configuration shown in FIG. 2, CAs 100 and 101 and controlled by processors 55 of cars 12 and 18, respectively. In other embodiments, CAs 100 and 101 may be controlled by a local controller, or by a master processor (e.g., processor 55 of car 18 or a remote master, such as the third party master) as described above.

In some embodiments, TEs 87 and 88 are configured, each, to be extended up to a predefined distance, e.g., between zero and five meters. The amount of extension depends on the safety requirements of the particular type of vehicle and cars. For example, the extension of each TE in a train may be about two, or three or four meters (or any other suitable size), whereas the extension in an automobile may be about one meter or less (or any other suitable size). The specified predefined distance may be determined, inter alia, based on the momentum (e.g., weight and/or speed) of the car, communication time delay, and the braking ability (e.g., deceleration rate, and/or distance the car is passing from receiving a stop command, time and distance to full stop).

As described in FIG. 1 above, car 18 loads passengers from station 22 and, when car 12 of vehicle 11 is located at a predefined distance from station 22, car 18 starts moving along route 33 in direction 44.

At an acceleration step 102, car 18 accelerates for a predefined time interval, so as to obtain approximately the speed of car 12. Note that at step 102 cars 12 and 18 are both moving and are separated from one another by a distance 112. Note that at step 102, TEs 88 and 87 are both in a collapsed and remain within cars 12 and 18, respectively.

At a first extension step 104, when car 18 still accelerates during the predefined time interval, car 12 moves at a speed higher than that of car 18, and thereby, is separated from car 18 at a distance 114, smaller than distance 112 of step 102 above. When cars 12 and 18 are separated from one another by distance 114, TEs 88 and 87 are getting started to extend toward one another. At a second extension step 106, both cars 12 and 16 are moving, but car 12 still moves at a speed higher than that of car 18, and therefore, is separated from car 18 at a distance 116, smaller than distance 114 of step 104 above. When cars 12 and 18 are separated from one another by distance 116, at least one of TEs 88 and 87 may continue to extend toward the other TE for making physical contact between CNs 99 and 98. For example, both TEs 88 and 87 may extend, or only one TE (e.g., TE 88) may extend while TE 87 may remain collapsed. Note that when one TE remains collapsed, the distance for coupling may be shortened (e.g., by half). In some embodiments, CNs 99 and 98 are connecting with one another at the end of step 106, embodiments related to the connecting process between CNs 99 and 98 is described in detail in FIGS. 3A-3C below. In other embodiments, at least one of TEs 87 and 88 may start extending only when both cars 12 and 18 are moving at the same speed, and at least one of cars 12 and 18 may accelerate or decelerate to accommodate for the required approximation between cars 12 and 18.

In some embodiments, TEs 88 and 87 may be used as dampers, configured to compensate for any variation in the relative speed between cars 12 and 18. TEs 88 and 87 may be used as hard dampers, for example, by pushing against car 12, which is over-approaching toward car 18, and thereby, maintain distance 116 at step 106. Additionally or alternatively, TEs 88 and 87 may be used as soft dampers. For example, in case car 12 is over-approaching toward car 18, processor 55 is configured to control at least one of TEs 88 and 87 to slightly collapse, while adjusting the relative speed between cars 12 and 18, and to extend after adjusting the relative speed and maintaining the specified distance between cars 12 and 18.

At a cars approaching step 108, after CNs 99 and 98 are connected with one another, cars 12 and 18 are moving closer to one another for being separated from one another by a distance 118, smaller than distance 116 of step 106 above. In some embodiments, TE 88 is configured to collapse toward car 12: (a) when cars 12 and 18 are getting closer to one another, or (b) when car 12 and 18 are disconnecting from one another. In other embodiments, TE 88 may remain folly or partially extended when car 12 and 18 are disconnecting from one another.

In some embodiments, after CNs 98 and 99 are connected and locked, electrical modules (not shown) of CAs 101 and 100 are coupled to one another, so that electricity, and various types of signals may be exchanged between cars 12 and 18. For example, when the electrical modules of CNs 98 and 99 are connected, communication devices 57 of cars 12 and 18, may exchange at least some signals using a wired communication channel, in addition to or instead of using wireless signals 53 described above. In such embodiments, communication devices 57 are configured to receive a signal indicating the availability of the wired communication channel, and based on the signal, to select between the wired and wireless channels for transmitting the signals.

At a dynamic coupling step 110, while both are still moving, cars 12 and 18 are coupled to one another so that passengers can move from car 18 toward their destination car of vehicle 11, e.g., car 12. Step 110 terminates the process for connecting two moving cars 12 and 18, and after concluding step 110, car 18 is integrated with vehicle 11 as described in FIG. 1 above.

In some embodiments, a reversed order of the process described in FIG. 2 may be used, mutatis mutandis, for disconnecting between two cars of vehicle 11. Note that when de-coupling between cars 12 and 18, it is essential to reduce the force (e.g., mutual pressure) applied between CAs 100 and 101, so as to disconnect between CNs 99 and 98, whereas when connecting between CAs 100 and 101, it is important to have mutual pressure applied between CAs 100 and 101, so as to carry out the latching and/or locking described above. Thus, after the extension is enlarged, the rare car (e.g., car 12) may slightly accelerate (or the front car may slightly decelerate) to reduce the mutual pressure and to enable the decoupling between CNs 98 and 99. In some embodiments, when cars 12 and 18 are disconnecting from one another, TEs 87 and 88 may be extended while CNs 98 and 99 are still connected with one another, e.g., as shown for example in step 108. Subsequently, when distance 112 is sufficiently large, e.g., as shown in step 106, CNs 98 and 99 are disconnecting from one another and TEs 87 and 88 are collapsing toward cars 18 and 12, respectively.

Note that the damping embodiments described in step 106 above, are also applicable for steps 108 and 110, as well as for the corresponding steps of the process for disconnecting between any cars (e.g., cars 12 and 18) of vehicle 11. Additional embodiments related to the extension and damping are described below.

In other embodiments, TEs 87 and 88 may remain collapsed when cars 12 and 18 are disconnecting from one another. In such embodiments, CNs 98 and 99 are disconnecting from one another at about the same time (or shortly before) cars 18 and 12 are decoupling from one another.

In alternative embodiments, instead of TEs 87 and 88, at least one of cars 12 and 18 may have a non-extending element having connectors, such as but not limited to CNs 98 and 99. These non-extending elements may be used for connecting between cars 12 and 18, and may also serve as dampers for damping any impact occurring by the coupling between cars 12 and 18. Coupling cars using such non-extending elements typically require fast communication and good coordination for performing a virtual coupling between cars 12 and 18. The term "virtual coupling" is described in detail below. Additionally or alternatively, extenders, such as but not limited to TEs 87 and 88, or any other type of non-telescopic extenders described below, may be used for damping the impact occurred when coupling between cars 12 and 18.

In yet other embodiments, at least one of TEs 87 and 88 may not collapse at step 108, for example, when connecting between cars 12 and 18 without transferring people and/or other objects between the cars. In the example of FIG. 2, cars 12 and 18 may be coupled via TEs 87 and 88 and connected between CNs 98 and 99, but the bodies of cars 12 and 18 remain separated from one another at a predefined distance (e.g., distance 116 or 118).

Typically, the processor 55 comprises a general-purpose processor, which is programmed in software to carry out the functions described herein. The software may be downloaded to the computer in electronic form, over a network, for example, or it may, alternatively or additionally, be provided and/or stored on non-transitory tangible media, such as magnetic, optical, or electronic memory.

In other embodiments, at least one of cars 12 and 18 may have, instead of or in addition to TEs 88 and 87, one or more extenders that are not telescopic. For example, an extender shaped as a squeezebox of an accordion may be compressed instead of the collapsing of the TE, and expanded, instead of the extending of the TE. Other examples of a non-telescopic extenders may be designed as a folding fence used in gardens and gates or any other suitable type of a controllable extending and collapsing apparatus.

Figure 3A:
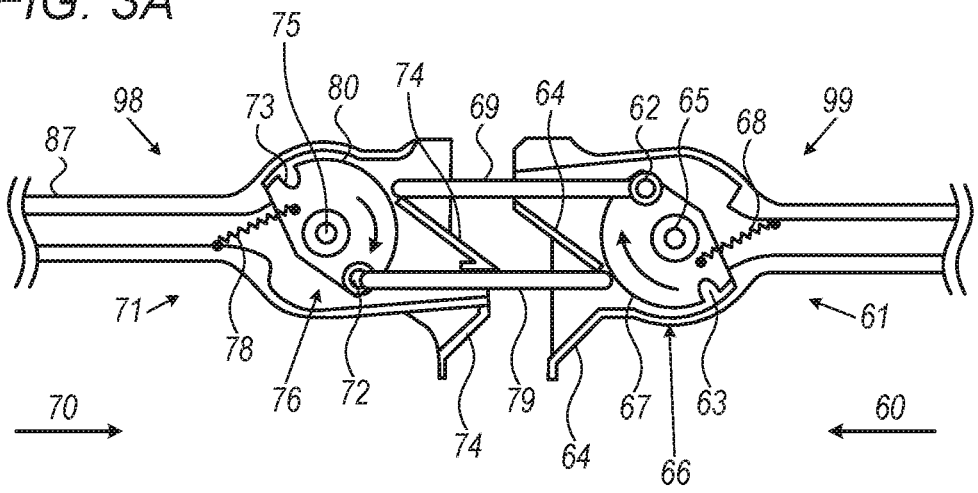
FIGS. 3A, 3B and 3C are schematic, sectional views of three respective positions of connectors used for dynamically connecting two or more moving cars of a transportation system, in accordance with an embodiment of the present invention.
Figure 3B:
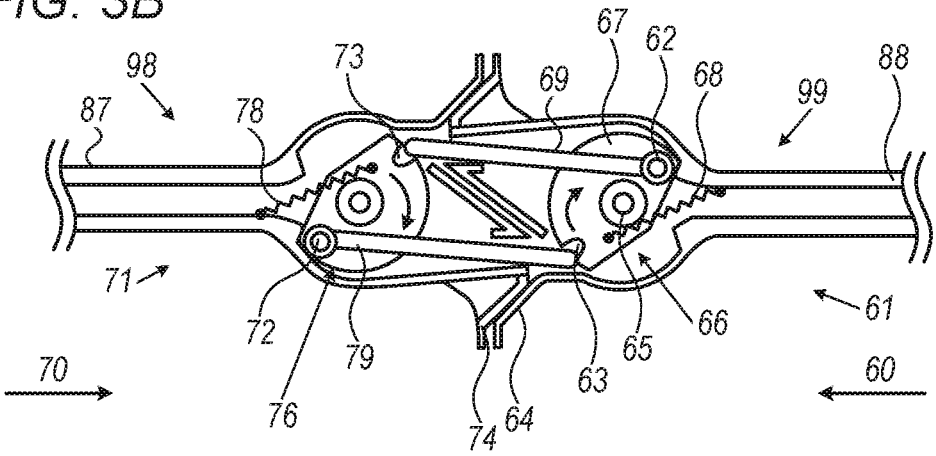
Figure 3C:
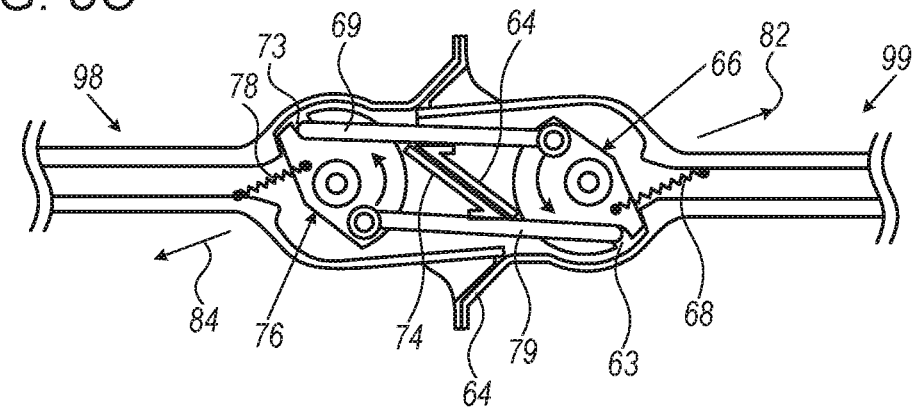

FIGS. 3A, 3B and 3C are schematic, sectional views of three respective positions of CNs 98 and 99 used for dynamically connecting moving cars 12 and 18 of system 10, in accordance with an embodiment of the present invention. As described in FIG. 2 above CNs 98 and 99 are coupled, respectively, to TEs 87 and 88.

Reference is now made to FIG. 3A. As described in FIG. 2 above, CNs 98 and 99 are both moving in direction 44, however, due to the different speeds of cars 18 and 12. CNs 98 and 99 are actually moving toward one another in opposite directions 70 and 60, respectively.

In some embodiments, CN 99 comprises a housing 61 having a distal end shaped as a cone 64. CN 99 comprises a disc 66, which is configured to rotate about a hinge 65. In the present example, disc 66 is rotated clockwise for connecting between CNs 98 and 99 as will be described in detail in FIGS. 3B and 3C below.

In some embodiments, a section of the circumference of disc 66 is shaped as an arc 67, and a notch 63 is formed in arc 67. A spring 68 is coupled between disc 66 and housing 61, and a shaft 69 is coupled to a hinge 62.

In some embodiments. CN 98 comprises a housing 71 having a distal end shaped as a cone 74. CN 98 comprises a disc 76, which is configured to rotate about a hinge 75. In a like manner to disc 66 described above, disc 76 is rotated clockwise for connecting between CNs 98 and 99.

In some embodiments, a section of the circumference of disc 76 is shaped as an arc 80, and a notch 73 is formed in arc 80. A spring 78 is coupled between disc 76 and housing 71, and a shaft 79 is coupled to a hinge 72. Shafts 69 and 79 are typically made from a rigid metal or any other suitable material. Note that shafts 69 and 79 pass, respectively, through openings of cones 64 and 74 of respective housings 61 and 71, such that the distal end of shaft 69 makes contact with arc 80 of disc 76, and the distal end of shaft 79 makes contact with arc 67 of disc 66.

Reference is now made to FIG. 3B. In some embodiments, cones 64 and 74 are shaped such that when CNs 98 and 99 are moving toward one another (e.g., in directions 70 and 60, respectively), cone 64 fits over cone 74. When TE 88 moves CN 99 in direction 60, disc 66 rotates clockwise and brings notch 63 in close proximity to the distal end (i.e., the end not connected to hinge 72) of shaft 79. Moreover, when disc 66 rotates clockwise, spring 68 of CN 99 is being stretched. Similarly, when TE 87 moves CN 98 in direction 70, disc 76 rotates clockwise and brings notch 73 in close proximity to the distal end of shaft 79, and spring 78 is being stretched. When discs 66 and 76 are sufficiently-rotated clockwise, the distal ends of shafts 69 and 79 are inserted into notches 73 and 63, respectively. In some embodiments, the distal ends of shafts 69 and 79 may have a pin, or any other suitable apparatus, for insertion into notches 73 and 63, respectively.

Reference is now made to FIG. 3C, showing a mechanism for locking CNs 98 and 99 to one another. As described above, the distal ends of shafts 69 and 79 are inserted into notches 63 and 73, respectively, and are stopping against respective discs 76 and 66. Subsequently, shafts 69 and 79 are pressed back into CNs 99 and 98, respectively, causing discs 76 and 66 to rotate until notches 73 and 63 align with shafts 69 and 79. After shafts 69 and 79 have entered, spring 68 applies to disc 66 force in a direction 82 and spring 78 applies to disc 76 force in a direction 84, so that notches 73 and 63 spring back into a position where shafts 69 and 79 are extended, and thereby lock CNs 98 and 99 to one another. In the locked position, forces on shafts 69 and 79 and discs 66 and 76 are balanced out, so that CNs 98 and 99 are remained locked.

The structure and functionality of CNs 98 and 99 is based on Scharfenberg couplers, provided, for example, by Voith Turbo Scharfenberg GmbH (Salzgitter, Germany). In other embodiments, CAs 100 and 101 may have any other suitable type of couplers or connectors, instead of or in addition to CNs 98 and 99.

In some embodiments, uncoupling between CNs 98 and 99 is executed by rotating at least one of the discs against the force of the respective spring. For example, rotating disc 66 clockwise against the force of spring 68. In response the clockwise rotation, the distal end of the respective shaft (e.g, shaft 79) is released from the respective notch (e.g., notch 63), and the same applies for shaft 69 and notch 73. As a result, CNs 98 and 99 are uncoupled. Note that the coupling and uncoupling of CNs 98 and 99, as described above, may be carried out manually, or using electrical and/or pneumatic mechanisms controlled, for example, by processor 55 and/or by an operator of the respective cars and/or of system 10. Additional embodiment and variations are described in detail, after FIG. 4 below.

The embodiments described in FIGS. 3A-3C are not limited to trains. In some embodiments, system 10 and the cars thereof (e.g., cars 12 and 18), may comprise any other type of transportation vehicle, such as but not limited to a bus, an intercity train, a light train, a suburban rail, an underground train, a boat, an automobile, a truck and an aircraft. Moreover, the cars (e.g., cars 12 and 18) of system 10 may transport any suitable types of objects, such as but not limited to, passengers, parcels, cargo and/or freight, or any suitable combination thereof.

Figure 4:
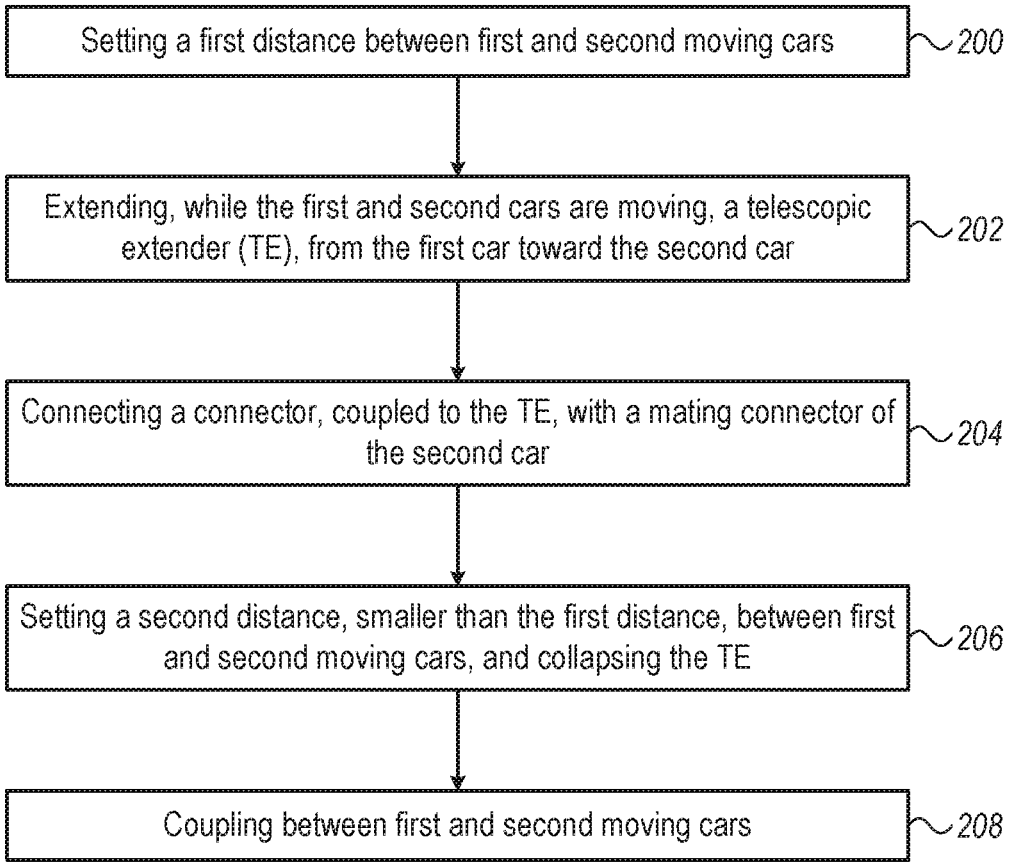
FIG. 4 is a flow chart that schematically illustrates a method for dynamically connecting two or more moving cars of a transportation system, in accordance with an embodiment of the present invention.

FIG. 4 is a flow chart that schematically illustrates a method for dynamically connecting two or more moving cars of system 10, in accordance with an embodiment of the present invention. The method begins at a first distance setting step 200, with setting a first distance between first and second moving cars. For example, setting distance 116 separating between moving cars 12 and 18 shown in FIG. 2 above. At an extending step 202, while cars 12 and 18 are moving, TE 88 of car 12 is extended toward car 18, and TE 87 of car 18 is extended toward car 12.

At a connecting step 204, CN 99, which is coupled to TE 88, is connected with a mating connector, e.g., CN 98, of car 18, as shown for example in step 106 of FIG. 2 above. At a second distance setting step 206, a second distance (e.g., distance 118 of FIG. 2 above), which is smaller than distance 116, is set for separating between moving cars 12 and 18, and at the same time, TEs 88 and 87 collapse toward cars 12 and 18, respectively, so that a combination of controlling the speed of cars 12 and 18 to obtain distance 118 and moving at least one of TEs 88 and 87 enables the latching and/or locking described in FIG. 2 above. At a car coupling step 208 that concludes the coupling method, cars 12 and 18 are coupled to one another while moving and collapsing TEs 88 and 87 toward cars 12 and 18, respectively. After concluding step 208, car 18 is integrated with vehicle 11 as described in FIGS. 1 and 2 above.

Additional Embodiments and Variations

Dynamic coupling assumes that the speed of two consecutive components (e.g., cars 12 and 18) is known with a relatively high accuracy and known delay. Thus, conventional safety margins (which assume static obstacles) are relatively conservative and therefore, expensive in terms of volume transportation. As such, relative speed (rather than absolute speed) is considered as a key parameter for deriving the safety requirements of system 10. Measuring relative speed allows two consecutive components (e.g., cars 12 and 18) to get in close proximity to one another while maintaining a sufficiently-safe distance therebetween. As described in FIG. 2 above, by having LCUs 54, cars are virtually mutually connected and informed of various parameters of one another, such as motion parameters (e.g., speed and acceleration).

In some embodiments, the coupling mechanism of system 10 may comprise: CNs 98 and 99 or any other suitable type of automatic coupler, TEs 87 and 88 for extension and damping as described in FIG. 2 above, a communication channel (e.g., between communication devices 57 of cars 12 and 18), sensors 56 for sensing the aforementioned motion parameters and distance between adjacent cars 12 and 18, processors 55 for controlling the motion parameters, distance between adjacent cars 12 and 18, and the operation of CAs 100 and 101 for coupling and decoupling between adjacent cars. The coupling mechanism may comprise a hazard and safety control mechanism, for example, using software features for controlling the aforementioned coupling and decoupling in response to input signals, such as detection of obstacles, or receiving negative clearance from the railway signaling system or train control system or other types of hazards along route 33.

In some embodiments described in FIG. 2 above, the communication channel is capable of transferring distance and speed measurements in real-time, as well as potential hazard alerts, while controlling speed and acceleration of both cars. When the cars are approaching one another, the speed and acceleration are adapted, so as to reduce relative speed, and thereby, allowing safe coupling. When the cars (e.g., cars 12 and 18) are sufficiently close to one another (e.g., at step 106 of FIG. 2 above), processor 55 activates CAs 100 and 101, so as to lock the automatic couplers (e.g., CNs 98 and 99) to one another and latch or be locked using any suitable technique.

In some embodiments, the dynamic coupling (as well as decoupling) between adjacent cars 12 and 18 is carried out under the supervision of the aforementioned hazard and safety control mechanism, which is implemented, for example, using processors 55, and is described in detail below.

In some embodiments, LCUs 54 are configured to continuously sense various parameters (as described in FIGS. 1 and 2 above) and to response to any variation in the dynamics of cars 12 and 18, so the leading car (e.g., car 18) does not change speed before ascertaining that the trailer car (e.g., car 12) started braking or reducing speed at a slowing rate determined, for example, by processor 55.

As described in FIGS. 1 and 2 above, the coupling between cars 12 and 18 is carried out after the front car (e.g., car 18) has accelerated and reached the speed of the rear car e.g., car 12), so that the rear car can approach the front car from behind and the two cars reach the distance required for coupling (e.g., distance 116 of FIG. 2 above). TEs 87 and 88 that serve as a coupling extension and damper mechanism, allow cars 12 and 18 that are maintained, e.g., by processors 55, in controlled distance and speed relative to one another, to couple and latch (e.g., having CNs 98 and 99 locked). Subsequently, TEs 87 and 88 are collapsed toward cars 18 and 12, respectively, and cars 12 and 18 are now coupled and moving in tandem as cars of vehicle 11.

In some embodiments, there are three types of couplers (i.e., connecting mechanism) for connecting between cars 12 and 18: (a) a manual coupler, using a mechanical, or pneumatic, or electrical connections, (b) a semi-automatic coupler, having an automatic mechanical connection, but manual only pneumatic and/or electric connections, and (c) fully automated couplers. In some embodiments, the semi-automatic coupler, also referred to herein as a semi-permanent coupler, is designed to ensure a permanent mechanical and pneumatic connection between the different cars of vehicle 11. The semi-permanent coupler does not have to be uncoupled unless there is a case of emergency or during maintenance of one or more of the connected cars. Both the coupling and the uncoupling of the semi-permanent couplers are carried out manually and must be carried out with both cars. In some embodiments, the semi-permanent coupler has a vulcanized metal-rubber articulation that allows relative movement between the cars. This coupler allows the coupled cars to resist both horizontal and vertical vibrations, as well as rotational movements. One or both of the two couplers between cars is provided with an energy absorption device, which is configured to absorb mechanical forces applied between the cars (e.g., between cars 12 and 18).

In some embodiments, an automatic coupler is configured to carry out mechanical coupling between two cars, by means of a simple approximation at a recommended speed of about 5 kilometer per hour (KPH), without any manual assistance. The electric and pneumatic connection of the respective cars are carried out automatically at the same time with the mechanical coupling. The automatic coupler allows the coupled cars to resist both horizontal and vertical vibrations, as well as a rotational movement. Uncoupling the cars is also automatic, and is carried out from the driver's desk, although in case of emergency it can be carried out manually by means of an uncoupling handle. In an embodiment, the automatic coupler is provided with an energy absorption device, configured to collapse under strong impacts for protecting the frames of the involved cars. Such automatic couplers may be supplied by various manufacturers, such as the aforementioned Voith GmbH, and other producers described in U.S. Provisional Patent Application 62/877,853, whose disclosure is incorporated herein by reference.

Train virtual coupling is a technology that applies direct (or indirect) communication between adjacent cars, such as cars 12 and 18, for shortening a safety distance therebetween. In virtual coupling, the specified safety distance takes in account the dynamics (e.g., motion parameters of each car and distance measured between the cars), relying on the communication channel (described above) between cars 12 and 18, and in the example of FIG. 2, automating the response of car 12 (also referred to herein as the trailing car in the present example) to hazard alert provided by car 18 (also referred to herein as the leading car in the present example), so as to prevent collision between cars 12 and 18.

One of the greatest challenges for virtual coupling safety is derailment of adjacent opposite direction rolling stock. In the context of the present disclosure, the term "derailment" refers to a car of system 10 falling out of route 33 undesirably (e.g., by accident). For example, when a train is getting off-track or when an automobile is falling off-road. Such undesired accidents are hazardous for passengers and other objects transported by the cars and vehicles of system 10 or any other transportation system. In these cases, the leading train, about to collide with the derailed train, cannot provide hazard alert in time to the virtually coupled second train, thus the latter does not have time to decelerate and will cause even higher speed collision. The virtual coupling safety is also problematic when approaching diverging junctions as the first train may derail due to junction malfunction and the second cannot brake in time to prevent collision. In some embodiments, system 10 is configured to address safety issues of virtual coupling by shortening the virtual coupling time-window required for physical connection during which it can be assured no opposite train or intersection is present, removing the virtual coupling drawbacks completely.

In some embodiments, one or more cars (typically all cars) of system 10 comprise an automatic coupler, such as CAs 101 and 100 having respective CNs 98 and 99 as shown in FIG. 2 above. The CAs are typically coupled at both side of the car so as to enable connecting with cars at the front and back sides of the car. In the example described in FIG. 2 above, when car 12 moves in direction 44, CA 100 is coupled at the front side (e.g., location 90) and an additional CA is coupled at the back side (e.g., location 92) of car 12.

The embodiments provided herein describe CAs 100 and 101 and the TEs and CNs thereof, but are applicable for all CAs, TEs and CNs of all cars of system 10.

In some embodiments, CNs 98 and 99 are configured to latch and lock automatically in response to having a predefined range of relative speeds between one another (e.g., between about 3 KPH and 5 KPH), using the connecting and locking mechanism described in FIGS. 3A-3C above, or by using any other suitable mechanism. Note that CNs 98 and 99 are configured to operate under longitudinal and lateral forces and vibrations, and to support a predefined range of tilting and rotation angles such as requirements specified in various railway engineering standards, e.g., I.S. EN 12663-1:2010, SS-EN 16019:2014, between cars 12 and 18, for example based on the interaction between cones 64 and 74 described in FIGS. 3A-3C above.

In some embodiments, each CA of system 10 comprises an electronic module (not shown), such that after CNs 98 and 99 are mechanically connected and locked, the electronic modules of CAs 100 and 101, are electrically connected, and are configured to produce signals indicative of the coupling status between CNs 98 and 99. Moreover, when the electronic modules of CAs 100 and 101 are electrically connected, communication devices 57 of CAs 100 and 101, are configured to exchange at least one of the communication signals over a wired connection (not shown) coupled between the electronic modules of CAs 100 and 101. Although CAs 100 and 101 are operated using electrical power provided by cars 12 and 18, respectively, CNs 98 and 99 may be operated (e.g, latching/locking and releasing) manually, for example, in case of emergency.

In some embodiments, TEs 87 and 88 (that serve as extenders and dampers as described above) are configured to provide to suppress and/or contain vibration differences between cars 12 and 18 and to sustain longitudinal forces and different required angles of the coupling after connecting CAs 100 and 101 successfully.

In some embodiments, CAs 100 and 101 are designed for high speed trains (e.g., trains, metro, and trams) and for automobiles (e.g., buses and minibuses). In such embodiments, each of TEs 87 and 88 is configured to extend to various sizes, such as but not limited to about 3-4 meters for rail cars, and about 0.5 meter for connected automobile cars, or any other suitable extension size, as described for example in FIG. 2 above. As shown in steps 108 and 110 of FIG. 2 above, after CNs 98 and 99 are connected, TEs 87 and 88 are configured to collapse toward cars 18 and 12, respectively.

In some embodiments, TEs 87 and 88 are configured for de-touching with a high-speed mechanism in case of hazard before the latching of CNs 98 and 99 and the collapsing of TEs 87 and 88. In some embodiments, the CNs and TEs of CAs 100 and 101 are designed to comply with collision-related and other forces applied between coupling and decoupling cars, as specified in the respective standards, such as EN 15227 standard, for coupling between cars of trains, automobiles and other types of vehicle described above.

In some embodiments, system 10 comprises a direct communication channel between cars 12 and 18, and between any two or more connecting cars. In the example of FIG. 2 above, the communication channel is set between communication devices 57 that exchange communication signals, such as wireless signals 53, for maintaining various operations, such as but not limited to relative speed, absolute speed, communication delay, acceleration and location between cars 12 and 18.

In some embodiments, the communication channel is configured to support bidirectional traffic, to maintain the direct link within a distance between about 20 km and fully connected between cars 12 and 18 (may have different specification for different types of vehicles, for example, train cars and automobile cars), and a communication delay smaller than about 1 millisecond (ms) when the distance between cars is smaller than about 1 km.

In some embodiments, the direct communication, also referred to herein as "point to point" communication, is encrypted and authenticated for improved safety and reliability. Moreover, the direct communication provides LOS (loss of signal) or loss of communication indication, when the communication is lost, with a delay of less than 1 ms.

In some embodiments, the cars of system 10 may have an external shape for obtaining an aerodynamic shape when connected with one another. For example, after coupling between adjacent cars, the backside of the leading car may fit over the front side of the training car, such that the connected cars appear as a single car. One example of this embodiment is shown in FIG. 2 of the aforementioned U.S. Provisional Patent Application 62/877,853.

In some embodiments, sensors 56 for measuring the distance and speed, are configured to measure the distance between cars 12 and 18 constantly (e.g., a range between every about 100 milliseconds and about 1 second) and accurately. The measurements are sufficiently-accurate to enable bringing cars 12 and 18 safely to a distance smaller than about one meter. For example, at an inter-car distance between about 15 km and about 1 m sensors 56 are configured to measure, and processor 55 is configured to control a distance value smaller than about ±3% of the actual distance. Similarly, for any speed between 450 KPH and 50 KPH sensors 56 are configured to measure, and processor 55 is configured to control a speed value smaller than about ±3% of the actual speed of each of the cars to be coupled or decoupled, and the relative speed between the respective cars (e.g., cars 12 and 18).

In some embodiments, system 10 and each LCU 54, have a fail-safe mechanism and are configured to produce an alert in response to any sort of failure to obtain the specified motion parameters and distance between cars 12 and 18 (and between any cars of system 10).

In an embodiment, the automatic speed and acceleration control mechanism helps control the cars relative positions before, during and after coupling and/or decoupling. Using the distance and speed measurements, at least one processor 55 (e.g., the master processor or both processors 55) is configured to generate coupling control commands to cars 12 and 18 to adjust their respective speed and acceleration for a fully automatic feedback until concluding the coupling and/or decoupling process, and as long as cars 12 and 18 are within the aforementioned distances (e.g., up to 15 km) between one another.

For example, (a) each car (e.g., cars 12 and 18) receives its own acceleration or deceleration control feedback, (b) in responds to the feedback, a command to adjust one or more motion parameters is generated within up-to 1 second, and/or speed of about 90 meter per second, and/or acceleration between about 0.5 and 3 meter/second$^2$.

In some embodiments, the automatic speed and acceleration control mechanism of LCU 54 is configured to respond to stop hazard alert with an emergency procedure for stopping the train. In the emergency procedure, the leading car (e.g., car 18) sends, directly or indirectly to the rear car (e.g., car 12), a signal indicative of a hazard (also referred to herein as a hazard signal), and car 18 does not start decelerating before receiving from car 12 acknowledgment to the hazard signal and an indication that car 12 has started to decelerate. The emergency procedure ensures that the leading car will start decelerating only after the rear car has already started to decelerate, and therefore, the rear car will not collide into the leading car. Moreover, in response to a communication error, the automatic speed and acceleration control mechanism of LCU 54 is configured to perform the emergency procedure, such that, in response to a hazard alert, car 12 decelerates before car 18 starts decelerating. The automatic speed and acceleration control mechanism of LCU 54 is configured to maintain a full duplex channel between processors 55 of cars 12 and 18, and having a continuous communication mechanisms to ensure that the communication between communication devices 57 is up and running at least when cars 12 and 18 are within a distance smaller than about 15 km from one another.

In some embodiments, the hazard and control mechanism, e.g., between cars 12 and 18, is designed such that cars 12 and 18 are considered as a single vehicle comprising them, while the coupling control is autonomous to allow low latency and fast response. Typically, the front car (e.g., car 18) continues to accelerate when a hazard occurs, so as to avoid the rear car (e.g., car 12) from colliding with the front car (e.g., car 18). Note that this feature does not change in essence the safety margins (also referred to herein as the safe distance or safety distance), the rear car's safety margin is the margin that should be taken into account, at least when the front car has not yet reached the speed of the rear car. Moreover, when the front car, e.g., car 18, is in the range of the safety margin from a forward potential obstacle, car 18 can still accelerate and maintain the aforementioned safety distance from car 12. FIG. 3 of the aforementioned U.S. Provisional Patent Application 62/877,853, shows an example graph of the acceleration of a front car (e.g., car 18 in the example of FIG. 2) in a train coupling case (represented in FIG. 2 by car 12) and the fact the safety margin is not compromised by continuing the acceleration after the hazard alert was issued. In some embodiments and as shown in the aforementioned graph, the total braking distance of the rear train (refers to car 12 of the present disclosure) is not compromised, the front car (refers to car 18 of the present disclosure) continues to accelerate and gain speed for about eight more seconds in order to avoid the rear train from reaching the front car. In the example of the aforementioned graph, both cars reach the same speed and continue with the same deceleration rate until obtaining full stop. A safety margin between the trains (e.g., cars 12 and 18 in the present disclosure) that compensates for the variance in deceleration rates and other mismatches can be maintained by maintaining the acceleration of the front car (e.g., car 18), or by delaying the deceleration of the rear car, which requires extended safety margin of the rear train towards a potential obstacle and/or other hazards, by the safety margin.

In some embodiments, any hazards detected by any entity of system 10 is communicated (e.g., by car 18) to car 12 by using the aforementioned point to point communication channel. Additionally or alternatively, any hazards detected by any entity of system 10, may be communicated to at least one of cars 12 and 18, via the aforementioned controlled sub-system (e.g., the CCU) or any other suitable third party. For example, a hazard detected by car 18 may be transmitted to the CCU, and from the CCU to car 12. Note that indirect communication typically add to the communication-related delays, and therefore, may require specifying larger safety margins as compared to the safety margins specified when cars 18 and 12 are communicating directly. In response to the hazard alert, LCU 54 of car 12 sends signals indicative of acknowledgment for the hazard alert, and an indication that car 12 started decelerating using any suitable braking system thereof. Subsequently, processor 55 of car 18 calculates and verifies that the current relative speed between cars 12 and 18, is similar (approximately equal) to the relative speed between cars 12 and 18 before receiving the hazard alert. In some embodiments, during the deceleration, processors 55 of cars 12 and 18 are configured to maintain a predefined minimal safety margin between cars 12 and 18, while the car 12 continues to brake, the control is maintained by car 18, which may or may not receive a deceleration command. In other words, the safe distance between cars 12 and 18 is maintained by first decelerating car 12 (which is the rear car), and only after obtaining suitable predefined conditions, such as but not limited to, safe distance and relative speed between cars 12 and 18, car 18 (which is the front car) starts to decelerate. Note that the same embodiments and procedure are applicable also in response to a communication loss between cars 12 and 18, or in response to any other safety-related event (e.g., a fire in car 12 or in car 18).

As described in FIG. 1 above, vehicle 11 and the cars of system 10 may comprise any other suitable type of transportation equipment, such as but not limited to a bus, an intercity train, a light train, a suburban rail, an underground train, a boat, an automobile, a truck, and a cargo and/or freight carrier (e.g., a train, a truck or a ship, or any other type of transportation equipment or vehicle described above). In yet other embodiments, vehicle 11 may comprise an aircraft (e.g., a drone) configured to carry passengers and/or parcels along a predefined route, and the cars may comprise smaller drones configured to load and unload the passengers and/or parcels between the aircraft and the stations. Embodiments described herein are related to automobiles, such as buses and minibuses, but are also applicable, mutatis mutandis, to one or more of the other types of transportation systems described above.

Traditional mechanisms for connecting between two buses or minibuses, comprises a swivel mechanism used for connecting two bus cabins into a single unit having two cabins. That solution is unsuitable for dynamic coupling as it is made of fabric and unable to connect and disconnect between two adjacent buses as required. In the embodiments described below, the term "car" refers to any suitable type of car, such as but not limited to a bus and a minibus.

In some embodiments, a dynamic coupling mechanism is configured to connect two cars and allow safe passage of passengers between the connected cars. Coupling is carried out at high speeds (e.g., at about the speed limit at the respective section of the route) so as to prevent the rear car from reducing the speed (the coupling may also be carried out at low speeds, e.g., in close proximity to a junction). The coupling of several cars into a single vehicle (such as vehicle 11 of FIG. 1 above) may create a very large convoy-like vehicle which may cause traffic complications, for example in junctions and in curvy section of the route.

In some embodiments, in order to accommodate all road conditions, the vehicle (also referred to herein as a combo-vehicle, is configured to split before junctions and/or curves into multiple sub-vehicles, each of which comprising one or more cars, and to reconnect for generating the combo-vehicle after passing the junction or curve. For example, in fully autonomous intersections, the autonomous combo-vehicles may refrain from blocking the junction by disconnecting between two or more cars, and reconnecting between the respective cars after passing the junction. In the example of FIG. 1, in case of a blocked intersection between stations 22 and 24, vehicle 11, which comprises (after coupling with car 18) cars 18, 12, 14 and 16, may disconnect between cars 12 and 14, so as to split into two pairs of cars before the intersection (e.g., cars 18 and 12, and cars 14 and 16) and reconnect between cars 12 and 14 after passing the intersection. In this example, processor 55 of car 12 may initiate the disconnection in response to receiving from sensors 56 of car 12, a signal indicating that cars 14 and 16 are blocking the intersection. Similarly, processors 55 of cars 11 and 14 may initiate the reconnection in response to receiving from sensors 56 of car 16 (the rear-most car of vehicle 11), a signal indicating that cars 14 and 16 have already passed through the intersection.

In some embodiments, the coupling mechanism is also configured to accommodate large angles of vehicle 11 in case of sharp turns (e.g., in a junction), or to split and reconnect before and after a turn, depending on the requirements of the respective route. In other embodiments, when vehicle 11 is used in routes that cross highways and do not have turns (or having non-sharp curves), the cars of vehicle 11 may have, instead of CAs 100 and 101, simpler coupling assemblies, e.g., for reducing the overall cost of system 10.

In some embodiments, the coupling assembly for coupling between two buses (e.g., cars 12 and 18) is configured to: (a) connect and disconnect between cars 12 and 18, (b) allow passengers to pass between the front bus (e.g., car 18) and the rear bus (e.g., car 12), (c) suppress and/or contain the forces and vibrations of each car, and between cars 12 and 18, (d) support turning of vehicle 11 at an angle up to ninety degrees, (e) sustains crash forces and maintain vehicle 11 as a single unit (e.g., a single car), (f) electrically connect between cars 12 and 18 for electricity and connectivity as required, (g) support automatic coupling on differential speeds of up-to 5 KPH between adjacent cars, (h) support manual and automatic connection and disconnection between cars 12 and 18, (i) have extensions and dampers, such as TEs 87 and 88, to allow connection of cars 12 and 18 within a suitable distance (e.g., of about two meters), and (j) collapse TEs 87 and 88 after connecting between CNs 98 and 99 and having them locked and/or latched.

In some embodiments, the communication channel between buses has the same features of the communication channel described above for exchanging communication signals between cars of any sort of a transportation system.

In some embodiments, when applied to automobiles, e.g., when cars 12 and 18 comprise buses, system 10 is configured to carry out the dynamic coupling and/or decoupling between the buses, using a safety distance smaller than a safety distance used when connecting between cars of a train.

In some embodiments, before direct communication is established between cars 12 and 18 (of any type of transportation system), the safety distance cannot not be reduced to a dynamic safety distance, and has to remain at the safety distance required according to existing regulations (e.g., of route 33), which assumes a conventional approach to the obstacle.

Even though the front car (e.g., car 18) is located inside the safety margin of the rear car (e.g., car 12), system 10 is configured for maintaining safety distance by continuing to accelerate car 18, and also control the speed thereof, as long as needed. At the same time, the safety margin of car 18 must be greater than required according to the existing regulations of route 33, in order to account for the needed safety margin between cars 12 and 18.

In some embodiments, safety is maintained by controlling the speed and acceleration of car 18 so as to prevent car 12 from colliding with car 18 due to high differential speed therebetween. The safety is also maintained by transferring information about hazards, e.g., from car 18 to car 12, and by extending the safety margin requirements between cars 12 and 18.

Although the embodiments described herein mainly address any type of transportation systems, such as trains, the methods and systems described herein can also be used in other types of transportation systems and other applications. For example, the disclosed techniques may be used, mutatis mutandis, for connecting between cars of any type of the aforementioned vehicles that are moving in the same direction and/or to a similar or common destination, with or without transferring passengers or goods between the cars. Moreover, the disclosed techniques may be used to also allow automation on assembling between entities like trains, or any other type of vehicles, in staging yards, automatically and while the cars are in motion.

It will thus be appreciated that the embodiments described above are cited by way of example, and that the present invention is not limited to what has been particularly shown and described hereinabove. Rather, the scope of the present invention includes both combinations and sub-combinations of the various features described hereinabove, as well as variations and modifications thereof which would occur to persons skilled in the art upon reading the foregoing description and which are not disclosed in the prior art. Documents incorporated by reference in the present patent application are to be considered an integral part of the application except that to the extent any terms are defined in these incorporated documents in a manner that conflicts with the definitions made explicitly or implicitly in the present specification, only the definitions in the present specification should be considered.

The invention claimed is:

1. A coupling assembly in first and second cars configured to move relative to one another, the coupling assembly comprising:

a first extender that, while at least one of the first and second cars is in motion, is configured to extend away from the first car for connecting with the second car;

a second extender that, while at least one of the first and second cars is in motion, is configured to extend away from the second car for connecting with the first car;

a first connector, which is coupled to the first extender, and is being moved relative to the first car in response to the first extender extending away from the first car telescopically; and a second connector, which is coupled to the second extender, and is being moved relative to the second car in response to the second extender extending away from the second car telescopically, wherein the first connector is configured to perform the following while at least one of the first and second cars is in motion:

(i) dynamically connect with the second connector when connecting between the first and second cars, and (ii) dynamically disconnect from the second connector when disconnecting the first car from the second car.

2. The coupling assembly according to claim 1, wherein at least the first extender is configured to extend away from the first car and the first connector is configured to dynamically connect with the second connector when the first and second cars are separated from one another by a first distance, and wherein, after dynamically connecting between the first connector and the second connector and while at least one of the first and second cars is in motion, at least the first extender is configured to at least partially collapse toward the first car for positioning the first car at a second distance from the second car, smaller than the first distance.

3. The coupling assembly according to claim 1, wherein at least one of the first and second cars comprises a transportation equipment selected from a list consisting of: a bus, an intercity train, a light train, a suburban rail, an underground train, a boat, an automobile, a truck, a ship, an aircraft and a drone.

4. The coupling assembly according to claim 1, wherein, for dynamically disconnecting between the first and second cars, at least one of: (i) the first extender is configured to telescopically collapse toward the first car, and (ii) the second extender is configured to telescopically collapse toward the first car.

5. The coupling assembly according to claim 1, and comprising a first local control unit (LCU) coupled to the first car, and a second LCU coupled to the second car, wherein the first and second LCUs comprise (i) one or more sensors, (ii) one or more communication devices, and (iii) a processor configured to receive signals from the sensors and the communication devices, and, based on the received signals, to control dynamic connection and dynamic disconnection between the first car and the second car.

6. The coupling assembly according to claim 5, wherein the signals comprise at least first and second signals, and wherein the processor is configured, in response to receiving the first signal, to control at least one of: (i) the first extender to extend away from the first car telescopically, and (ii) the second extender to extend away from the second car telescopically, and in response to receiving the second signal, to control at least one of: (i) the first extender to dynamically collapse toward the first car, and (ii) the second extender to dynamically collapse toward the second car.

7. The coupling assembly according to claim 5, wherein the processor is configured to control one or more parameters selected from a list consisting of: (a) speed, (b) acceleration and deceleration, (c) a distance between the first and second cars, (d) a distance to a nearest station, (e) a distance to a hazard, and (f) braking capabilities.

8. The coupling assembly according to claim 5, wherein the one or more sensors are configured to sense one or more physical parameters selected from a list consisting of: (a) speed, (b) acceleration and deceleration, (c) a distance between the first and second cars, and (d) a distance to a hazard.

9. The coupling assembly according to claim 5, wherein the first LCU comprises a first communication device and the second LCU comprises a second communication device, and wherein, (a) when the first connector and the second connector are disconnected, the first and second communication devices configured to exchange the signals wirelessly, and (b) when the first connector and the second connector are connected, the first and second communication devices are configured to exchange at least some of the signals over a wired connection.

10. The coupling assembly according to claim 5, and comprising a first set of one or more first cars and a second set of one or more second cars, wherein the first and second sets of cars are moving along a route, and wherein the first and second LCUs are configured to control: (a) a dynamic connection between the first and second sets at a first section of the route, and (b) a dynamic disconnection between the first and second sets at a second section of the route.

11. The coupling assembly according to claim 5, wherein the first and second cars are disconnected from one another and are moving along a route such that the first car is a leading car and the second car is following the first car, and wherein, in response to detecting a hazard along the route, the first and second LCUs are configured to coordinate deceleration of the first and second cars.

12. The coupling assembly according to claim 11, wherein the second LCU is configured to control the second car to decelerate, and subsequently, the first LCU is configured to control the first car to decelerate.

13. The coupling assembly according to claim 5, wherein at least one of the first extender and the second extender is configured to damp an impact occurring when dynamically connecting between the first car and the second car.

14. A method for coupling between first and second cars moving relative to one another, the method comprising:

while at least one of the first and second cars is in motion and the first and second cars are separated from one another by a given distance:

extending away telescopically from the first car, a first extender coupled to a first connector, for moving the first connector relative to the first car, and for connecting with the second car;

extending away telescopically from the second car, a second extender coupled to a second connector, for moving the second connector relative to the second car, and for connecting with the first car; and dynamically connecting between a first connector coupled to the first extender and a second connector coupled to the second extender.

15. The method according to claim 14, and comprising, after dynamically connecting between the first connector and the second connector and while at least one of the first and second cars is in motion, telescopically collapsing at least one of: (i) the first extender toward the first car, and (ii) the second extender toward the second car, for positioning the first car at another distance from the second car, smaller than the given distance.

16. The method according to claim 14, wherein at least one of the first and second cars comprises a transportation equipment selected from a list consisting of: a bus, an intercity train, a light train, a suburban rail, an underground train, a boat, an automobile, a truck, a ship, an aircraft and a drone.

17. The method according to claim 14, and comprising, while the first and second cars are dynamically connected with one another and at least one of the first and second cars is in motion, dynamically disconnecting between the first car and the second car by: (a) dynamically disconnecting between the first connector and the second connector, and (b) telescopically collapsing at least one of: (i) the first extender toward the first car, and (ii) the second extender toward the second car.

18. The method according to claim 14, and comprising receiving from signals sensors and communication devices, and based on the received signals, controlling dynamic connection or dynamic disconnection between the first car and the second car.

* * * * *